US009222711B2

(12) United States Patent
Ochiai et al.

(10) Patent No.: US 9,222,711 B2
(45) Date of Patent: Dec. 29, 2015

(54) REFRIGERATING AND AIR-CONDITIONING APPARATUS

(75) Inventors: Yasutaka Ochiai, Tokyo (JP); Fumitake Unezaki, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 710 days.

(21) Appl. No.: 13/579,969

(22) PCT Filed: Mar. 12, 2010

(86) PCT No.: PCT/JP2010/001778

§ 371 (c)(1),
(2), (4) Date: Aug. 20, 2012

(87) PCT Pub. No.: WO2011/111114

PCT Pub. Date: Sep. 15, 2011

(65) Prior Publication Data

US 2012/0318011 A1 Dec. 20, 2012

(51) Int. Cl.
*F25B 45/00* (2006.01)
*F25B 49/00* (2006.01)

(52) U.S. Cl.
CPC ..... *F25B 49/005* (2013.01); *F25B 2500/19* (2013.01); *F25B 2500/222* (2013.01); *F25B 2700/04* (2013.01)

(58) Field of Classification Search
CPC ..... F25B 45/00; F25B 2500/222; F25B 2500/24; F25B 2500/23; F25B 2700/04; F25B 2500/22; F25B 2500/221; F25B 2500/223
See application file for complete search history.

(56) References Cited

U.S. PATENT DOCUMENTS 4,149,574 A * 4/1979 Lehmann et al. ..... 141/59
4,367,637 A * 1/1983 Paulokat ..... 62/292

(Continued)

FOREIGN PATENT DOCUMENTS

CN 101156033 A 4/2008
CN 101326416 A 12/2008

(Continued)

OTHER PUBLICATIONS

International Search Report (PCT/ISA/210) issued on Apr. 20, 2010, by the Japanese Patent Office as the International Searching Authority for International Application No. PCT/JP2010/001778.

(Continued)

*Primary Examiner* — Ljiljana Ciric
*Assistant Examiner* — Alexis Cox
(74) *Attorney, Agent, or Firm* — Buchanan Ingersoll & Rooney PC

(57) ABSTRACT

A refrigerating and air-conditioning apparatus including a refrigerant circuit, which in turn includes an outdoor unit, and an indoor unit, connected by an extension pipe. The apparatus further includes a control unit having a memory, and is configured to calculate an internal volume of the extension pipe and calculate a standard refrigerant amount, serving as a criterion for determining whether the refrigerant is leaked from the refrigerant circuit, on the basis of the calculated refrigerant extension pipe internal volume. The memory is configured to store the refrigerant extension pipe internal volume and the standard refrigerant amount. The control unit is configured to calculate a total amount of refrigerant in the refrigerant circuit on the basis of the refrigerant extension pipe internal volume stored in the memory and operation data measured during normal operation, and compare the calculated total refrigerant amount with the standard refrigerant amount stored in the memory to determine whether refrigerant is leaked.

11 Claims, 7 Drawing Sheets

(56) References Cited

U.S. PATENT DOCUMENTS

| | | | | |
|---|---|---|---|---|
| 4,688,388 | A * | 8/1987 | Lower et al. | 62/126 |
| 4,711,096 | A * | 12/1987 | Krantz | 62/129 |
| 5,009,076 | A * | 4/1991 | Winslow | 62/129 |
| 5,142,876 | A * | 9/1992 | Snider et al. | 62/77 |
| 7,640,758 | B2 * | 1/2010 | Esslinger | 62/149 |
| 2002/0139128 | A1 * | 10/2002 | Suzuki et al. | 62/129 |
| 2002/0152759 | A1 * | 10/2002 | Brass et al. | 62/124 |
| 2004/0055317 | A1 * | 3/2004 | Nomura et al. | 62/149 |
| 2005/0072168 | A1 * | 4/2005 | Beatenbough et al. | 62/149 |
| 2005/0086951 | A1 * | 4/2005 | Dobmeier et al. | 62/127 |
| 2005/0109050 | A1 * | 5/2005 | Laboe et al. | 62/199 |
| 2005/0126190 | A1 * | 6/2005 | Lifson et al. | 62/129 |
| 2006/0137364 | A1 * | 6/2006 | Braun et al. | 62/126 |
| 2006/0137368 | A1 * | 6/2006 | Kang et al. | 62/149 |
| 2009/0025406 | A1 | 1/2009 | Yoshimi et al. | |
| 2009/0100849 | A1 | 4/2009 | Nishimura et al. | |
| 2009/0126379 | A1 | 5/2009 | Yamaguchi et al. | |
| 2009/0314017 | A1 * | 12/2009 | Nishimura et al. | 62/149 |
| 2010/0300129 | A1 * | 12/2010 | Bean et al. | 62/129 |
| 2011/0308267 | A1 * | 12/2011 | Tamaki et al. | 62/222 |
| 2011/0314854 | A1 * | 12/2011 | Sata et al. | 62/190 |
| 2012/0180506 | A1 * | 7/2012 | Ochiai et al. | 62/126 |
| 2013/0067942 | A1 * | 3/2013 | Ochiai et al. | 62/126 |
| 2014/0174114 | A1 * | 6/2014 | Tamaki et al. | 62/129 |

FOREIGN PATENT DOCUMENTS

| | | | |
|---|---|---|---|
| CN | 101473177 | A | 7/2009 |
| EP | 1970652 | A1 | 9/2008 |
| JP | 56-80660 | A | 7/1981 |
| JP | 2007-163099 | A | 6/2007 |
| JP | 2007-163102 | A | 6/2007 |
| JP | 2008-51496 | A | 3/2008 |
| JP | 2008-64453 | A | 3/2008 |
| JP | 4155313 | B2 | 9/2008 |
| JP | 2008-232579 | A | 10/2008 |
| JP | 2009-139012 | A | 6/2009 |
| WO | WO 2008/035418 | A1 | 3/2008 |

OTHER PUBLICATIONS

Office Action (Notice of Reasons for Rejection) issued on Sep. 24, 2013, by the Japanese Patent Office in corresponding Japanese Patent Application No. 2012-504156, and an English Translation of the Office Action. (5 pages).

Office Action (Notification of the First Office Action) issued on Mar. 7, 2014, by the Chinese Patent Office in corresponding Chinese Patent Application No. 201080065367.1, and an English Translation of the Office Action. (16 pages).

Office Action (Notification of the First Office Action) issued Dec. 26, 2013 by the Chinese Patent Office in corresponding Chinese Patent Application No. 201080047641.2, and an English translation thereof (14 pages).

Office Action issued Sep. 15, 2014 by the Chinese Patent Office in corresponding Chinese Patent Application No. 201080047641.2 and an English translation thereof (14 pages).

Office Action (Notification of Reasons for Refusal) issued Jun. 19, 2012 by the Japanese Patent Office in corresponding Japanese Patent Application No. 2009-244133 (4 pages).

Office Action issued Apr. 30, 2015 by the USPTO in corresponding U.S. Appl. No. 13/498,367 (12 pages).

International Search Report issued Aug. 3, 2010 by the Japanese Patent Office in corresponding International Application PCT/JP2010/002866 (5 pages).

Office Action (Notification of Reasons for Refusal) issued Sep. 13, 2011 by the Japanese Patent Office in corresponding Japanese Patent Application No. 2009-244133 (4 pages).

* cited by examiner

REFRIGERATING AND AIR-CONDITIONING APPARATUS

TECHNICAL FIELD

The present invention relates to increasing the accuracy of a function for calculating the amount of refrigerant in a refrigerant circuit in a refrigerating and air-conditioning apparatus including an outdoor unit, serving as a heat source, and an indoor unit, serving as a use side, connected through a refrigerant extension pipe.

BACKGROUND ART

There has been a method of calculating the amount of refrigerant in a split refrigerating and air-conditioning apparatus which includes an outdoor unit, serving as a heat source unit, and an indoor unit, serving as a use side, connected through refrigerant extension pipes, the method including performing operations for determining the volumes of the refrigerant extension pipes (two operations with different densities in the refrigerant extension pipe during cooling), dividing an increase or decrease in refrigerant in parts other than the refrigerant extension pipes between two operation states by a change in density of the refrigerant in the extension pipes to obtain the volumes of the refrigerant extension pipes, and calculating the refrigerant amount (refer to Patent Literature 1, for example).

CITATION LIST

Patent Literature

Patent Literature 1: Japanese Unexamined Patent Application Publication No. 2007-163102 (summary)

SUMMARY OF INVENTION

Technical Problem

Disadvantageously, the above-described method of estimating the internal volumes of the refrigerant extension pipes requires much time and effort, since special operations, i.e., the operations for calculating the internal volumes of the refrigerant extension pipes necessary for calculation of the internal volumes of the refrigerant extension pipes upon installation of the refrigerating and air-conditioning apparatus are performed. Moreover, it is difficult to perform the operations for calculating the internal volume of a refrigerant extension pipe in an existing refrigerating and air-conditioning apparatus.

The present invention has been made in consideration of the above-described circumstances and an object of the present invention is to provide a refrigerating and air-conditioning apparatus capable of accurately calculating the internal volume of a refrigerant extension pipe using operation data obtained during normal operation, and accurately performing calculation of the total amount of refrigerant in a refrigerant circuit, and detection of refrigerant leakage.

Solution to Problem

The present invention provides a refrigerating and air-conditioning apparatus including a refrigerant circuit in which an outdoor unit, serving as a heat source unit, and an indoor unit, serving as a use side unit, are connected by a refrigerant extension pipe, a measurement unit configured to measure, as operation data, a temperature and a pressure in each essential part of the refrigerant circuit, a calculation unit having an operation data acquisition requirement for acquiring operation data, the calculation unit being configured to repeat a process of acquiring operation data measured by the measurement unit during normal operation as initial learning operation data when an operation state indicated by the operation data meets the operation data acquisition requirement to sequentially obtain a plurality of sets of initial learning operation data, calculate an amount of refrigerant in parts other than the extension pipe and an extension-pipe density on the basis of each set of operation data, calculate an internal volume of the extension pipe on the basis of a group of data items indicating the calculations, and calculate a standard refrigerant amount, serving as a criterion for determination as to whether the refrigerant is leaked from the refrigerant circuit, on the basis of the calculated extension-pipe internal volume and the initial learning operation data, a storage unit configured to store the extension-pipe internal volume and the standard refrigerant amount, and a determination unit configured to calculate the total amount of refrigerant in the refrigerant circuit on the basis of the extension-pipe internal volume stored in the storage unit and operation data measured by the measurement unit during normal operation, and compare the calculated total refrigerant amount with the standard refrigerant amount stored in the storage unit to determine whether the refrigerant is leaked.

Advantageous Effects of Invention

According to the present invention, even in an existing apparatus, the internal volume of a refrigerant extension pipe can be calculated using operation data obtained during normal operation without any special operation. In addition, since the extension-pipe internal volume is calculated on the basis of a group of calculation data items indicating a plurality of refrigerant amounts in parts other than the extension pipe and a plurality of extension-pipe densities, the effect of a measurement error caused by the measurement unit on the extension-pipe internal volume to be calculated can be reduced, so that the extension-pipe internal volume can be calculated with high accuracy. Advantageously, calculation of the total refrigerant amount in the refrigerant circuit and detection of refrigerant leakage can be achieved with high accuracy.

DESCRIPTION OF EMBODIMENTS

A refrigerating and air-conditioning apparatus according to Embodiment of the present invention will be described below with reference to the drawings.

<Configuration of Apparatus>

Figure 1:
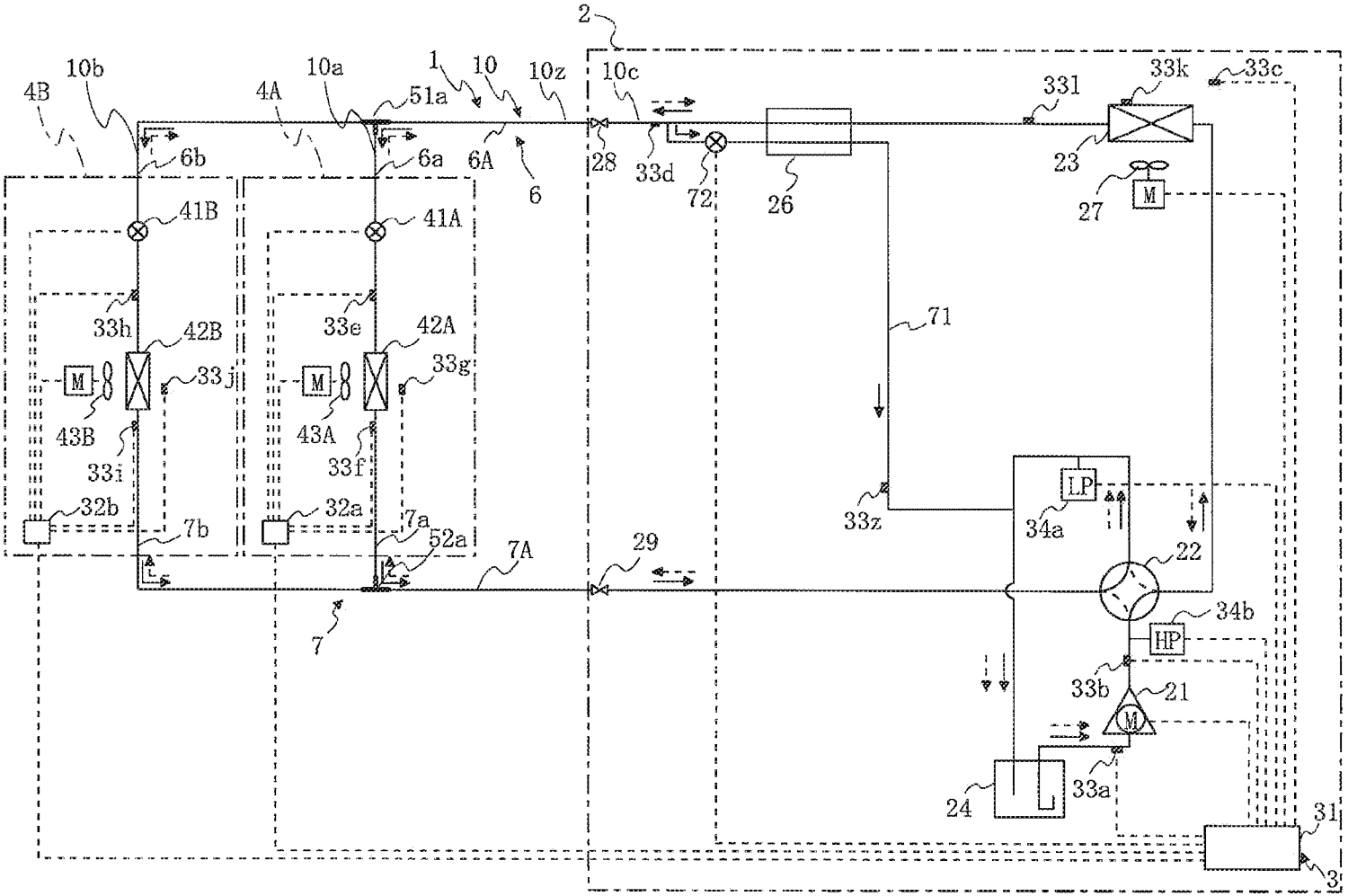
FIG. 1 is a diagram of a refrigerant circuit of a refrigerating and air-conditioning apparatus 1 according to Embodiment of the present invention.

FIG. 1 is a schematic diagram of the refrigerating and air-conditioning apparatus 1 according to Embodiment of the present invention. The refrigerating and air-conditioning apparatus 1 is an apparatus which performs a vapor compression refrigeration cycle operation such that it is used for cooling or heating an indoor space in a building, for example. The refrigerating and air-conditioning apparatus 1 primarily includes an outdoor unit 2, serving as a heat source unit, a plurality of (in Embodiment, two) indoor units 4A and 4B, serving as use units, connected in parallel to the outdoor unit 2, a liquid refrigerant extension pipe 6, and a gas refrigerant extension pipe 7. The liquid refrigerant extension pipe 6 is a pipe which connects the outdoor unit 2 to the indoor units 4A and 4B and through which a liquid refrigerant passes, and includes a liquid main pipe 6A, liquid branch pipes 6*a* and 6*b*, and a branch unit 51*a* such that these components are connected. Furthermore, the gas refrigerant extension pipe 7 is a pipe which connects the outdoor unit 2 to the indoor units 4A and 4B and through which a gas refrigerant passes, and includes a gas main pipe 7A, gas branch pipes 7*a* and 7*b*, and a branch unit 52*a* such that these components are connected.

(Indoor Units)

The indoor units 4A and 4B are arranged such that, for example, each unit is concealed in or suspended from a ceiling of an indoor space of a building or the like, or is hung on a wall of the indoor space. Each of the indoor units 4A and 4B is connected to the outdoor unit 2 using the liquid refrigerant extension pipe 6 and the gas refrigerant extension pipe 7 so as to constitute part of a refrigerant circuit 10.

The configurations of the indoor units 4A and 4B will now be described. Since the indoor units 4A and 4B have the same configuration, only the configuration of the indoor unit 4A will be described herein. Components of the indoor unit 4B correspond to components assigned reference symbol B instead of reference symbol A indicating components of the indoor unit 4A.

The indoor unit 4A primarily includes an indoor side refrigerant circuit 10*a* (the indoor unit 4B includes an indoor side refrigerant circuit 10*b*) constituting part of the refrigerant circuit 10. The indoor side refrigerant circuit 10*a* primarily includes an expansion valve 41A, serving as an expansion mechanism, and an indoor heat exchanger 42A, serving as a use side heat exchanger.

In Embodiment, the expansion valve 41A is an electric expansion valve connected to a liquid side of the indoor heat exchanger 42A so as to control, for example, the flow rate of a refrigerant flowing through the indoor side refrigerant circuit 10A.

In Embodiment, the indoor heat exchanger 42A is a cross-fin fin-and-tube heat exchanger, which includes a heat transfer tube and many fins, functioning as a refrigerant evaporator during cooling operation to cool indoor air and functioning as a refrigerant condenser during heating operation to heat the indoor air.

In Embodiment, the indoor unit 4A includes an indoor fan 43A, serving as an air-sending fan, configured to supply the air as supply air to the indoor space after sucking the indoor air into the unit and exchanging heat between the indoor air and the refrigerant through the indoor heat exchanger 42A. The indoor fan 43A is a fan capable of changing the flow rate of air supplied to the indoor heat exchanger 42A. In Embodiment, for example, it is a centrifugal fan, multi-blade fan, or the like driven by a DC fan motor.

The indoor unit 4A further includes various sensors. Gas side temperature sensors 33*f* and 33*i* configured to detect a temperature of the refrigerant (i.e., a refrigerant temperature corresponding to a condensing temperature Tc during the heating operation or an evaporating temperature Te during the cooling operation) are arranged on gas sides of the indoor heat exchangers 42A and 42B, respectively. Liquid side temperature sensors 33*e* and 33*h* configured to detect a refrigerant temperature Teo are arranged on liquid sides of the indoor heat exchangers 42A and 42B, respectively. Indoor temperature sensors 33*g* and 33*j* configured to detect a temperature (i.e., an indoor temperature $T_r$) of the indoor air flowing into the unit are arranged on indoor-air suction sides of the indoor units 4A and 4B, respectively. In Embodiment, each of the above-described temperature sensors 33*e*, 33*f*, 33*g*, 33*h*, 33*i*, and 33*j* is a thermistor.

The indoor units 4A and 4B further include indoor side control units 32*a* and 32*b* configured to control operations of the components constituting the indoor units 4A and 4B, respectively. Each of the indoor side control units 32*a* and 32*b* includes a microcomputer and a memory provided for control of the corresponding one of the indoor units 4A and 4B and is configured to be capable of transmitting and receiving, for example, control signals to/from a remote control (not illustrated) for individual operation of the corresponding one of the indoor units 4A and 4B and transmitting and receiving, for example, control signals to/from the outdoor unit 2 through a transmission line.

(Outdoor Unit)

The outdoor unit 2 is placed in an outdoor space surrounding a building or the like and is connected to the indoor units 4A and 4B by the liquid main pipe 6A, the liquid branch pipes 6*a* and 6*b*, the gas main pipe 7A, and the gas branch pipes 7*a* and 7*b* so as to constitute the refrigerant circuit 10 together with the indoor units 4A and 4B.

The configuration of the outdoor unit 2 will now be described. The outdoor unit 2 primarily includes an outdoor side refrigerant circuit 10*c* which constitutes part of the refrigerant circuit 10. The outdoor side refrigerant circuit 10*c* primarily includes a compressor 21, a four-way valve 22, an outdoor heat exchanger 23, an accumulator 24, a subcooler 26, a liquid side closing valve 28, and a gas side closing valve 29.

The compressor 21 is a compressor capable of varying an operation capacity. In Embodiment, it is a positive-displacement compressor driven by a motor whose frequency F is controlled by an inverter. In Embodiment, only one compressor 21 is disposed. The number of compressors is not limited to one. Two or more compressors may be connected in parallel in accordance with the number of connected indoor units, for example.

The four-way valve 22 is a valve for switching between flow directions of the refrigerant. The four-way valve 22 performs switching as indicated by solid lines during the cooling operation such that the discharge side of the compressor 21 is connected to the gas side of the outdoor heat exchanger 23 and the accumulator 24 is connected to the gas main pipe 7A. Consequently, the outdoor heat exchanger 23 functions as a condenser for the refrigerant compressed by the compressor 21. In addition, the indoor heat exchangers 42A and 42B each function as an evaporator. The four-way valve 22 performs switching indicated by broken lines in the four-way valve during the heating operation such that the discharge side of the compressor 21 is connected to the gas main pipe 7A and the accumulator 24 is connected to the gas side of the outdoor heat exchanger 23. Consequently, the indoor heat exchangers 42A and 42B each function as a condenser of the refrigerant compressed by the compressor 21. In addition, the outdoor heat exchanger 23 functions as an evaporator.

In Embodiment, the outdoor heat exchanger 23 is a cross-fin fin-and-tube heat exchanger which includes a heat transfer tube and many fins. As described above, the outdoor heat exchanger 23 functions as a refrigerant condenser during the cooling operation and functions as a refrigerant evaporator during the heating operation. The gas side of the outdoor heat exchanger 23 is connected to the four-way valve 22 and the liquid side thereof is connected to the liquid main pipe 6A.

In Embodiment, the outdoor unit 2 includes an outdoor fan 27, serving as an air-sending fan configured to discharge the air to the outdoor space after sucking the outdoor air into the unit and exchanging heat between the outdoor air and the refrigerant through the outdoor heat exchanger 23. The outdoor fan 27 is a fan capable of varying the flow rate of air supplied to the outdoor heat exchanger 23. In Embodiment, for example, it is a propeller fan or the like driven by a motor, e.g., a DC fan motor.

The accumulator 24 is connected between the four-way valve 22 and the compressor 21 and is a container capable of storing an excess refrigerant generated in the refrigerant circuit 10 depending on fluctuations of operating loads of the indoor units 4A and 4B.

The subcooler 26 is a double-pipe heat exchanger and is provided so as to cool the refrigerant, condensed by the outdoor heat exchanger 23, to be sent to the expansion valves 41A and 41B. In Embodiment, the subcooler 26 is connected between the outdoor heat exchanger 23 and the liquid side closing valve 28.

In Embodiment, a bypass 71 is provided as a cooling source of the subcooler 26. In the following description, part other than the bypass 71 of the refrigerant circuit 10 will be called a main refrigerant circuit 10*z*.

The bypass 71 is connected to the main refrigerant circuit 10*z* such that part of flow of the refrigerant from the outdoor heat exchanger 23 to the expansion valves 41A and 41B branches off from the flow through the main refrigerant circuit 10*z* and returns to the suction side of the compressor 21. Specifically, the bypass 71 is connected such that part of the flow of the refrigerant from the outdoor heat exchanger 23 to the expansion valves 41A and 41B branches off from the flow at a position between the subcooler 26 and the liquid side closing valve 28 and returns through a bypass flow control valve 72, which is an electric expansion valve, and the subcooler 26 to the suction side of the compressor 21. Accordingly, the refrigerant sent from the outdoor heat exchanger 23 to the expansion valves 41A and 41B is cooled in the subcooler 26 by the refrigerant, depressurized through the bypass flow control valve 72, flowing through the bypass 71. Specifically, controlling the opening degree of the bypass flow control valve 72 controls the capacity of the subcooler 26.

The liquid side closing valve 28 and the gas side closing valve 29 are valves arranged at connecting ports for external devices or pipes (specifically, the liquid main pipe 6A and the gas main pipe 7A).

The outdoor unit 2 further includes a plurality of pressure sensors and a plurality of temperature sensors. As the pressure sensors, a suction pressure sensor 34*a* configured to detect a suction pressure (pressure of a low-pressure refrigerant) Ps of the compressor 21 and a discharge pressure sensor 34*b* configured to detect a discharge pressure (pressure of a high-pressure refrigerant) $P_d$ of the compressor 21 are arranged.

Each of the temperature sensors is a thermistor. As the temperature sensors, a suction temperature sensor 33*a*, a discharge temperature sensor 33*b*, a heat exchange temperature sensor 33*k*, a liquid side temperature sensor 33*l*, a liquid pipe temperature sensor 33*d*, a bypass temperature sensor 33*z*, and an outdoor temperature sensor 33*c* are arranged.

The suction temperature sensor 33*a* is disposed at a position between the accumulator 24 and the compressor 21 and detects a suction temperature Ts of the compressor 21. The discharge temperature sensor 33*b* detects a discharge temperature $T_d$ of the compressor 21. The heat exchange temperature sensor 33*k* detects a temperature of the refrigerant flowing through the outdoor heat exchanger 23. The liquid side temperature sensor 33*l* is disposed on the liquid side of the outdoor heat exchanger 23 and detects a refrigerant temperature on the liquid side of the outdoor heat exchanger 23. The liquid pipe temperature sensor 33*d* is disposed at an outlet of the subcooler 26 on the side to the main refrigerant circuit 10*z* and detects a temperature of the refrigerant. The bypass temperature sensor 33*z* detects a temperature of the refrigerant flowing from an outlet of the subcooler 26 in the bypass 71. The outdoor temperature sensor 33*c* is disposed on the outdoor-air suction side of the outdoor unit 2 and detects a temperature of the outdoor air flowing into the unit.

The outdoor unit 2 further includes an outdoor side control unit 31 that controls operations of the components constituting the outdoor unit 2. The outdoor side control unit 31 includes a microcomputer provided for control of the outdoor unit 2, a memory, and an inverter circuit for controlling the motors. The outdoor side control unit 31 is configured to transmit and receive, for example, control signals to/from the indoor side control units 32*a* and 32*b* of the indoor units 4A and 4B through transmission lines. The outdoor side control unit 31 and the indoor side control units 32*a* and 32*b* constitute a control unit 3 that controls an operation of the whole refrigerating and air-conditioning apparatus 1.

Figure 2:
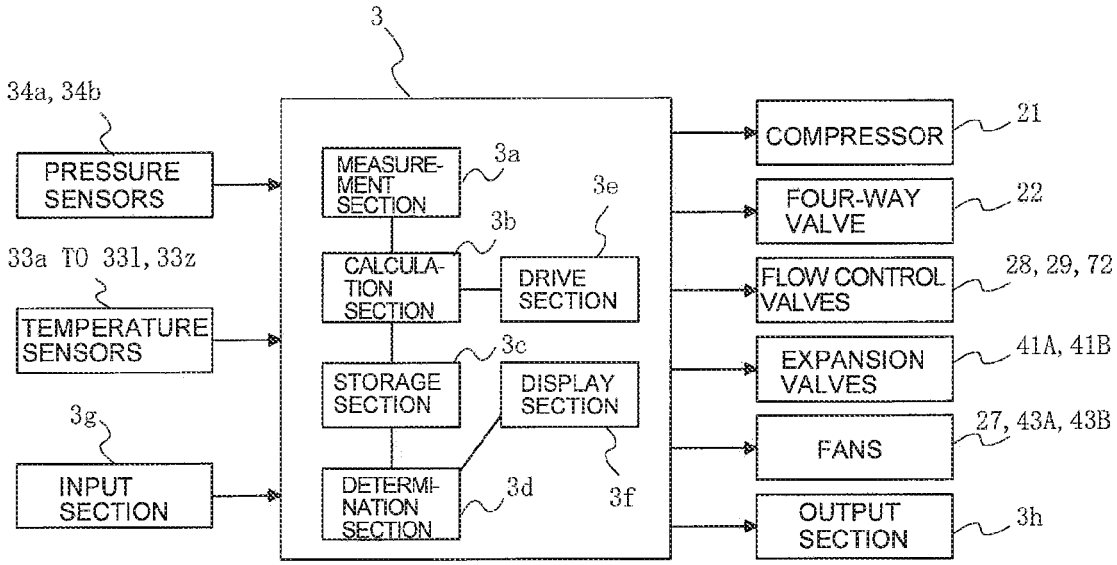
FIG. 2 is a block diagram of a control unit 3 for the refrigerating and air-conditioning apparatus and its peripheral components of the refrigerating and air-conditioning apparatus 1 according to Embodiment of the present invention.

FIG. 2 is a control block diagram of the refrigerating and air-conditioning apparatus 1. The control unit 3 is connected to the pressure sensors 34*a* and 34*b* and the temperature sensors 33*a* to 33*l* and 33*z* such that the unit can receive detection signals from the sensors and is further connected to the various components (the compressor 21, the fan 27, and the fans 43A and 43B) and valves (the four-way valve 22, the flow control valves (the liquid side closing valve 28, the gas side closing valve 29, and the bypass flow control valve 72), and the expansion valves 41A and 41B) such that the unit can control the various components and valves on the basis of, for example, the detection signals.

Furthermore, the control unit 3 includes a measurement section 3*a*, a calculation section 3*b*, a storage section 3*c*, a determination section 3*d*, a drive section 3*e*, a display section 3*f*, an input section 3*g*, and an output section 3*h*. The measurement section 3*a* is a portion which is configured to measure data from the pressure sensors 34*a* and 34*b* and the temperature sensors 33*a* to 33*l* and 33*z* and which constitutes a measurement unit together with the pressure sensors 34*a* and 34*b* and the temperature sensors 33*a* to 33*l* and 33*z*. The calculation section 3*b* is a portion configured to calculate the internal volumes of the refrigerant extension pipes on the basis of, for example, data measured by the measurement section 3*a* and calculate a standard refrigerant amount as a criterion for leakage of the refrigerant from the refrigerant circuit 10. The storage section 3*c* is a portion configured to store a value measured by the measurement section 3*a* and a value calculated by the calculation section 3*b*, internal volume data and an initial charge amount which will be described later, and information supplied from an external device. The determination section 3*d* is a portion configured to determine whether the refrigerant is leaked by comparing the total refrigerant amount in the refrigerant circuit 10 obtained by calculation with the standard refrigerant amount stored in the storage section 3*c*.

The drive section 3*e* is a portion configured to control a compressor motor, the valves, and the fan motors, serving as components driving the refrigerating and air-conditioning apparatus 1. The display section 3*f* is a portion configured to display information indicating that, for example, refrigerant charging is completed, or refrigerant leakage is detected in order to provide notification to the outside or display an abnormal condition caused during operation of the refrigerating and air-conditioning apparatus 1. The input section 3*g* is a portion configured to input or change set values for various controls or input external information, such as a refrigerant charge amount. The output section 3*h* is a portion configured to output a measured value obtained by the measurement section 3*a* or a value calculated by the calculation section 3*b* to an external device. The output section 3*h* may function as a communication section for communication with an external device. The refrigerating and air-conditioning apparatus 1 is configured to be capable of transmitting refrigerant leakage status data indicating a result of detection of refrigerant leakage to, for example, a remote control center through a communication line or the like.

The control unit 3 with the above-described configuration performs an operation while switching between the cooling operation and the heating operation, serving as normal operations, through the four-way valve 22 and controls the various components of the outdoor unit 2 and the indoor units 4A and 4B in accordance with operating loads of the indoor units 4A and 4B. In addition, the control unit 3 performs a refrigerant leakage detecting process, which will be described later.

(Refrigerant Extension Pipes)

The refrigerant extension pipes, which connect the outdoor unit 2 to the indoor units 4A and 4B, are pipes necessary for circulating the refrigerant in the refrigerating and air-conditioning apparatus 1.

The refrigerant extension pipes include the liquid refrigerant extension pipe 6 (the liquid main pipe 6A and the liquid branch pipes 6*a* and 6*b*) and the gas refrigerant extension pipe 7 (the gas main pipe 7A and the gas branch pipes 7*a* and 7*b*) and are pipes constructed on site upon installation of the refrigerating and air-conditioning apparatus 1 in an installation location, such as a building. The refrigerant extension pipes having diameters determined in accordance with the combination of the outdoor unit 2 and the indoor units 4A and 4B are used.

The length of each refrigerant extension pipe varies depending on installation conditions on site. Accordingly, the internal volume of the refrigerant extension pipe cannot be previously input before shipment, since the internal volume varies from installation site to installation site. It is therefore necessary to calculate the internal volume of each refrigerant extension pipe on each site. A method of calculating the internal volume of each refrigerant extension pipe will be described in detail later.

In Embodiment, the branch units 51*a* and 52*a* and the refrigerant extension pipes (the liquid refrigerant extension pipe 6 and the gas refrigerant extension pipe 7) are used to connect the single outdoor unit 2 to the two indoor units 4A and 4B. As regards the liquid refrigerant extension pipe 6, the liquid main pipe 6A connects the outdoor unit 2 to the branch unit 51*a* and the liquid branch pipes 6*a* and 6*b* connect the branch unit 51*a* to the indoor units 4A and 4B, respectively. As regards the gas refrigerant extension pipe 7, the gas branch pipes 7*a* and 7*b* connect the branch unit 52*a* to the indoor units 4A and 4B, respectively, and the gas main pipe 7A connects the branch unit 52*a* to the outdoor unit 2. While a T-shaped tube is used as each of the branch units 51*a* and 52*a* in Embodiment, the branch unit is not limited to this type. A header may be used. In the case where a plurality of indoor units are connected, a plurality of T-shaped tubes may be used for distribution. Alternatively, a header may be used.

As described above, the indoor side refrigerant circuits 10*a* and 10*b*, the outdoor side refrigerant circuit 10*c*, and the refrigerant extension pipes (the liquid refrigerant extension pipe 6 and the gas refrigerant extension pipe 7) are connected, thus constituting the refrigerant circuit 10. The refrigerating and air-conditioning apparatus 1 includes the refrigerant circuit 10 and the bypass 71. In the refrigerating and air-conditioning apparatus 1 according to Embodiment, the control unit 3, composed of the indoor side control units 32*a* and 32*b* and the outdoor side control unit 31, performs an operation while switching between the cooling operation and the heating operation through the four-way valve 22 and controls the various components of the outdoor unit 2 and the indoor units 4A and 4B in accordance with operating loads of the indoor units 4A and 4B.

<Operation of Refrigerating and Air-Conditioning Apparatus 1>

Operations of the components of the refrigerating and air-conditioning apparatus 1 according to Embodiment during normal operation will now be described.

The refrigerating and air-conditioning apparatus 1 according to Embodiment performs, as a normal operation, the cooling operation or the heating operation and controls the components of the outdoor unit 2 and those of the indoor units 4A and 4B in accordance with operating loads of the indoor units 4A and 4B. The cooling operation and the heating operation will be described below in that order.

(Cooling Operation)

Figure 3:
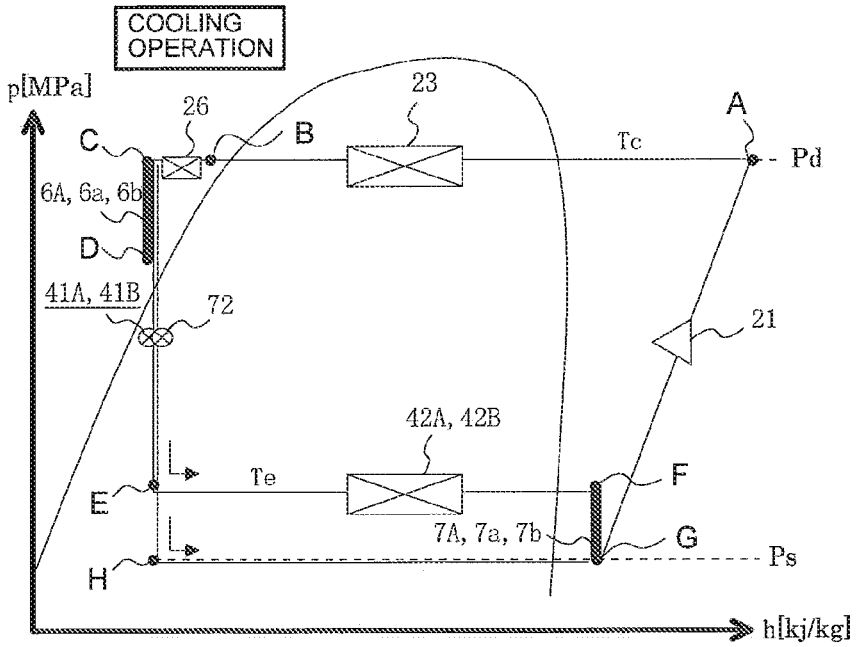
FIG. 3 is a p-h diagram during cooling operation of the refrigerating and air-conditioning apparatus 1 according to Embodiment of the present invention.

FIG. 3 is a p-h diagram during the cooling operation of the refrigerating and air-conditioning apparatus 1 according to Embodiment of the present invention. The cooling operation will be described below with reference to FIGS. 1 and 3.

During the cooling operation, the four-way valve 22 is in a state indicated by the solid lines in FIG. 1, namely, the discharge side of the compressor 21 is connected to the gas side of the outdoor heat exchanger 23 and the suction side of the compressor 21 is connected to the gas sides of the indoor heat exchangers 42A and 42B by the gas side closing valve 29 and the gas refrigerant extension pipe 7 (the gas main pipe 7A and the gas branch pipes 7*a* and 7*b*). Furthermore, all of the liquid side closing valve 28, the gas side closing valve 29, and the bypass flow control valve 72 are opened.

The flow of the refrigerant in the main refrigerant circuit 10*z* in the cooling operation will now be described.

The refrigerant flow in the cooling operation is indicated by solid-line arrows in FIG. 1. A high-temperature, high-pressure gas refrigerant (at the point A in FIG. 3) compressed by the compressor 21 flows through the four-way valve 22 into the outdoor heat exchanger 23, in which the refrigerant is condensed and liquefied (at the point B in FIG. 3) by an air-sending operation of the fan 27. A condensing temperature at this time is determined by the heat exchange temperature sensor 33*k* or is obtained by conversion of a pressure detected by the discharge pressure sensor 34*b* into a saturation temperature.

The degree of subcooling of the refrigerant, condensed and liquefied in the outdoor heat exchanger 23, is further increased (at the point C in FIG. 3) in the subcooler 26. The degree of subcooling at the outlet of the subcooler 26 is obtained by subtraction of a temperature detected by the liquid pipe temperature sensor 33*d* disposed on the outlet side of the subcooler 26 from the above-described condensing temperature.

After that, the refrigerant flows through the liquid side closing valve 28 and the pressure of the refrigerant then falls (at the point D in FIG. 3) due to pipe wall friction in the liquid main pipe 6A and the liquid branch pipes 6*a* and 6*b*, which constitute the liquid refrigerant extension pipe 6. The refrigerant is sent to the indoor units 4A and 4B and is then depressurized by the expansion valves 41A and 41B, thus turning into a low-pressure two-phase gas-liquid refrigerant (at the point E in FIG. 3). The two-phase gas-liquid refrigerant gasifies (at the point F in FIG. 3) due to an air-sending operation of each of the indoor fans 43A and 43B in the indoor heat exchangers 42A and 42B, serving as evaporators.

An evaporating temperature at this time is measured by each of the liquid side temperature sensors 33*e* and 33*h*. The degree of superheat, SH, of the refrigerant at an outlet of each of the indoor heat exchangers 42A and 42B is obtained by subtraction of a temperature of the refrigerant detected by the corresponding one of the liquid side temperature sensors 33*e* and 33*h* from a temperature of the refrigerant detected by the corresponding one of the gas side temperature sensors 33*f* and 33*i*. The opening degree of each of the expansion valves 41A and 41B is controlled so that the degree of superheat SH of the refrigerant at the outlet of the corresponding one of the indoor heat exchangers 42A and 42B (i.e., on the gas side of the corresponding one of the indoor heat exchangers 42A and 42B) reaches a superheat target value SHm.

The gas refrigerant (at the point F in FIG. 3) passed through the indoor heat exchangers 42A and 42B reach the gas branch pipes 7*a* and 7*b* and the gas main pipe 7A, which constitute the gas refrigerant extension pipe 7. The pressure of the refrigerant falls (at the point G in FIG. 3) due to pipe wall friction of the pipes while the refrigerant passes through the pipes. The refrigerant then passes through the gas side closing valve 29 and the accumulator 24 and returns to the compressor 21.

The flow of the refrigerant in the bypass 71 will now be described. An inlet of the bypass 71 is positioned between the outlet of the subcooler 26 and the liquid side closing valve 28. The bypass 71 permits part of the flow of the high-pressure liquid refrigerant (at the point C in FIG. 3) cooled by the subcooler 26 to branch off from the flow, be depressurized by the bypass flow control valve 72 such that it turns into a low-pressure two-phase refrigerant (at the point H in FIG. 3), and then flow into the subcooler 26. In the subcooler 26, the refrigerant passed through the bypass flow control valve 72 in the bypass 71 exchanges heat with the high-pressure liquid refrigerant in the main refrigerant circuit 10*z*, thus cooling the high-pressure refrigerant flowing through the main refrigerant circuit 10*z*. Consequently, the refrigerant flowing through the bypass 71 evaporates and gasifies and then returns to the compressor 21 (at the point G in FIG. 3).

At this time, the opening degree of the bypass flow control valve 72 is controlled so that the degree of superheat, SHb, of the refrigerant at the outlet of the subcooler 26 in the bypass 71 reaches a superheat target value SHbm. In Embodiment, the degree of superheat SHb of the refrigerant at the outlet of the subcooler 26 in the bypass 71 is obtained by subtraction of a saturation temperature, converted from the suction pressure Ps of the compressor 21 detected by the suction pressure sensor 34*a*, from a refrigerant temperature detected by the bypass temperature sensor 33*z*. Furthermore, a temperature sensor (not provided in Embodiment) may be disposed between the bypass flow control valve 72 and the subcooler 26 and the degree of superheat SHb of the refrigerant at the outlet of the subcooler 26 in the bypass may be detected by subtraction of a refrigerant temperature measured by this temperature sensor from a refrigerant temperature measured by the bypass temperature sensor 33*z*.

Furthermore, although the inlet of the bypass 71 is positioned between the outlet of the subcooler 26 and the liquid side closing valve 28 in Embodiment, it may be disposed between the outdoor heat exchanger 23 and the subcooler 26.

(Heating Operation)

Figure 4:
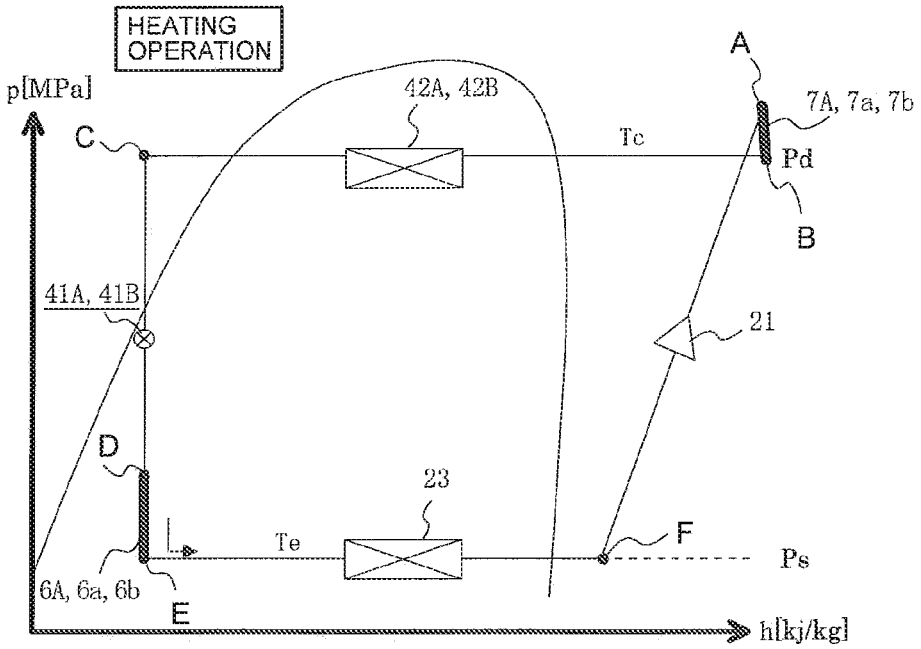
FIG. 4 is a p-h diagram during heating operation of the refrigerating and air-conditioning apparatus 1 according to Embodiment of the present invention.

FIG. 4 is a p-h diagram during the heating operation of the refrigerating and air-conditioning apparatus 1 according to Embodiment of the present invention. The heating operation will be described below with reference to FIGS. 1 and 4.

During the heating operation, the four-way valve 22 is in a state indicated by the broken lines in FIG. 1, namely, the discharge side of the compressor 21 is connected to the gas sides of the indoor heat exchangers 42A and 42B by the gas side closing valve 29 and the gas refrigerant extension pipe 7 (the gas main pipe 7A and the gas branch pipes 7*a* and 7*b*) and the suction side of the compressor 21 is connected to the gas side of the outdoor heat exchanger 23. Furthermore, the liquid side closing valve 28 and the gas side closing valve 29 are opened and the bypass flow control valve 72 is closed.

The flow of the refrigerant in the main refrigerant circuit 10*z* in the heating operation will now be described.

The refrigerant flow under heating conditions is indicated by broken-line arrows in FIG. 1. A high-temperature, high-pressure refrigerant (at the point A in FIG. 4) compressed by the compressor 21 passes through the gas main pipe 7A and the gas branch pipes 7*a* and 7*b*, which constitute the refrigerant gas extension pipe. At this time, the pressure of the refrigerant falls (at the point B in FIG. 4) due to pipe wall friction. Then, the refrigerant reaches each of the indoor heat exchangers 42A and 42B. In each of the indoor heat exchangers 42A and 42B, the refrigerant condenses and liquefies (at the point C in FIG. 4) due to an air-sending operation of the corresponding one of the indoor fans 43A and 43B and is then depressurized by the corresponding one of the expansion valves 41A and 41B, thus turning into a low-pressure two-phase gas-liquid refrigerant (at the point D in FIG. 4).

At this time, the opening degree of each of the expansion valves 41A and 41B is controlled so that the degree of subcooling, SC, of the refrigerant at the outlet of the corresponding one of the indoor heat exchangers 42A and 42B is kept constant at a subcooling target value SCm. In Embodiment, the degree of subcooling SC of the refrigerant at the outlet of each of the indoor heat exchangers 42A and 42B is detected by subtraction of a refrigerant temperature detected by the corresponding one of the liquid side temperature sensors 33*e* and 33*h* from a refrigerant saturation temperature, corresponding to the condensing temperature Tc, converted from the discharge pressure $P_d$ of the compressor 21 detected by the discharge pressure sensor 34*b*.

Furthermore, temperature sensors (not used in Embodiment) may be arranged to detect a temperature of the refrigerant flowing through each of the indoor heat exchangers 42A and 42B. The degree of subcooling SC of the refrigerant at the outlet of each of the indoor heat exchangers 42A and 42B may be detected by subtraction of a refrigerant temperature, corresponding to the condensing temperature Tc, detected by the corresponding one of the temperature sensors from a refrigerant temperature detected by the corresponding one of the liquid side temperature sensors 33*e* and 33*h*. After that, the pressure of the low-pressure two-phase gas-liquid refrigerant falls (at the point E in FIG. 4) due to pipe wall friction in the liquid main pipe 6A and the liquid branch pipes 6*a* and 6*b*, which constitute the liquid refrigerant extension pipe 6. The refrigerant then passes through the liquid side closing valve 28 and reaches the outdoor heat exchanger 23. In the outdoor heat exchanger 23, the refrigerant evaporates and gasifies (at the point F in FIG. 4) due to an air-sending operation of the outdoor fan 27. The refrigerant passes through the four-way valve 22 and accumulator 24 and then returns to the compressor 21.

(Method of Detecting Refrigerant Leakage)

The flow of the method of detecting refrigerant leakage will now be described. Detection of refrigerant leakage is performed at all times during operation of the refrigerating and air-conditioning apparatus 1. Furthermore, the refrigerating and air-conditioning apparatus 1 is configured to transmit refrigerant leakage status data indicating a result of refrigerant leakage detection to, for example, the control center (not illustrated) through the communication line so as to enable remote monitoring.

In Embodiment, a method of calculating the total amount of refrigerant charged in the existing refrigerating and air-conditioning apparatus 1 to determine whether the refrigerant is leaked will be described as an example.

Figure 5:
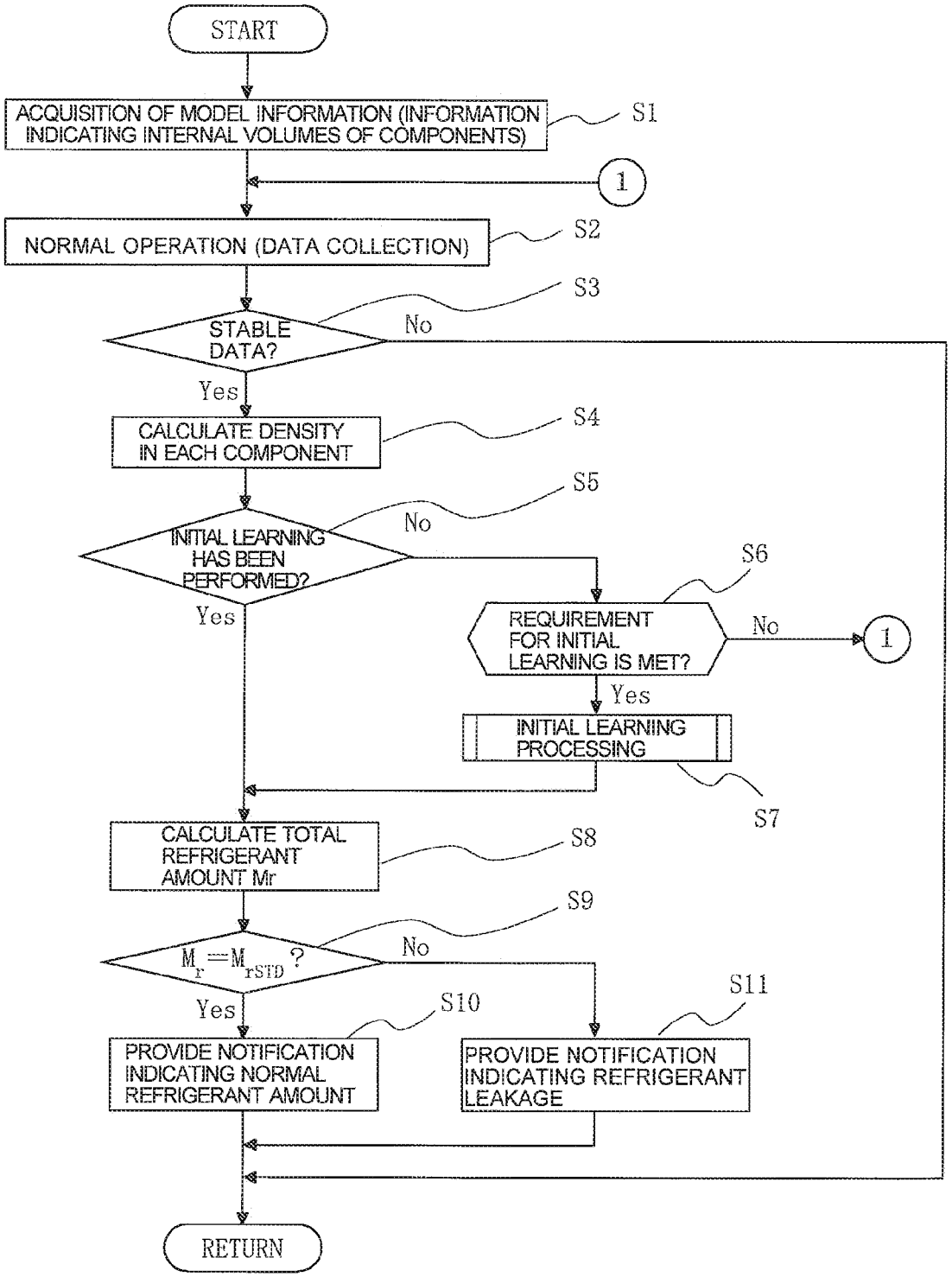
FIG. 5 is a flowchart of a method of detecting refrigerant leakage in the refrigerating and air-conditioning apparatus 1 according to Embodiment of the present invention.

The method of detecting refrigerant leakage will now be described with reference to FIG. 5. FIG. 5 is a flowchart illustrating the flow of the refrigerant leakage detecting process in the refrigerating and air-conditioning apparatus 1 according to Embodiment of the present invention. A special operation for refrigerant leakage detection is not performed. Refrigerant leakage detection is performed during normal cooling operation or heating operation. Refrigerant leakage detection is performed using operation data obtained during such an operation. Specifically, the control unit 3 performs the process illustrated by the flowchart of FIG. 5 while performing a normal operation. In this case, operation data are data indicating the quantity of operation state, such as, measured values obtained by the pressure sensors 34*a* and 34*b* and the temperature sensors 33*a* to 33*l* and 33*z*.

First, as regards model information acquisition in step S1, the control unit 3 acquires the internal volume of each component, which is necessary for refrigerant amount calculation, in the refrigerant circuit 10 from the storage section 3*c*. In this case, the internal volumes of the components other than the liquid refrigerant extension pipe 6 and the gas refrigerant extension pipe 7 are acquired. Specifically, the internal volumes of pipes and devices (the compressor 21, the outdoor heat exchanger 23, and the subcooler 26) in the indoor units 4A and 4B and those of pipes and devices (the indoor heat exchangers 42A and 42B) in the outdoor unit 2 are acquired. Data indicating the internal volumes necessary for calculation of the amount of refrigerant in the parts other than the refrigerant extension pipes in the refrigerant circuit 10 is previously stored in the storage section 3*c* of the control unit 3. As regards storage of the data indicating these interval volumes into the storage section 3*c* of the control unit 3, an installer may input the data through the input section 3*g*. Alternatively, when the outdoor unit 2 and the indoor units 4A and 4B are installed and communication setting is performed, the control unit 3 may communicate with, for example, the external control center to automatically acquire the data.

Subsequently, in step S2, the control unit 3 collects current operation data (data obtained from the temperatures sensors 33*a* to 33*l* and 33*z* and the pressure sensors 34*a* and 34*b*). In the refrigerant leakage detection in Embodiment, whether the refrigerant is leaked is determined on the basis of only normal data necessary for operating the refrigerating and air-conditioning apparatus 1. Accordingly, it is unnecessary to take time and effort to, for example, install a new sensor for refrigerant leakage detection.

Subsequently, in step S3, whether the operation data collected in step S2 is stable data is determined. If it is stable data, the process proceeds to step S4. For example, a refrigerant circuit operation is unstable in the case where the rotation speed of the compressor 21 fluctuates or the opening degrees of the expansion valves 41A and 41B fluctuate upon, for example, activation. It can therefore be determined that the current operation state is not stable on the basis of the operation data collected in step S2. In this case, refrigerant leakage detection is not performed.

In step S4, the density of the refrigerant in each of parts other than the liquid refrigerant extension pipe 6 and the gas refrigerant extension pipe 7 of the refrigerant circuit 10 is calculated using the stable data (operation data) obtained in step S3. The density of the refrigerant is obtained in step S4 since it is data necessary for calculation of the refrigerant amount. The density of the refrigerant passing through each of the components, serving as the parts other than the liquid refrigerant extension pipe 6 and the gas refrigerant extension pipe 7, of the refrigerant circuit 10 can be calculated using a known method. Specifically, the density in a single-phase part where the refrigerant is liquid or gaseous can be fundamentally calculated on the basis of pressure and temperature. For example, the refrigerant is gaseous in a part between the compressor 21 and the outdoor heat exchanger 23. The density of the gas refrigerant in this part can be calculated on the basis of a discharge pressure detected by the discharge pressure sensor 34*b* and a discharge temperature detected by the discharge temperature sensor 33*b*.

As regards the density in a two-phase part, such as a heat exchanger, where a two-phase state changes, a two-phase density mean value is calculated on the basis of the quantities of states at the inlet and outlet of such a device using an approximate expression. The approximate expression and the like necessary for such calculations are previously stored in the storage section 3*c*. The control unit 3 calculates the refrigerant density in each of the components other than the liquid refrigerant extension pipe 6 and the gas refrigerant extension pipe 7 of the refrigerant circuit 10 on the basis of the operation data obtained in step S3 and data indicating the approximate expression and the like previously stored in the storage section 3*c*.

Subsequently, whether initial learning has been performed is determined in step S5. The initial learning is a process of calculating the internal volume of the liquid refrigerant extension pipe 6 and that of the gas refrigerant extension pipe 7 and calculating the standard refrigerant amount necessary for detection of whether the refrigerant is leaked. The internal volume of each component, such as the indoor unit or the outdoor unit, is determined for each type of device and is therefore known. Whereas, the internal volume of a refrigerant extension pipe cannot be previously stored as known data in the storage section 3*c*, since the length of the refrigerant extension pipe varies depending on installation conditions on site. Furthermore, this case is intended for the existing refrigerating and air-conditioning apparatus 1. Accordingly, the internal volumes of the refrigerant extension pipes are unknown. In the initial learning, therefore, after installation, the refrigerating and air-conditioning apparatus is actually operated and the internal volumes of the refrigerant extension pipes are calculated using operation data obtained during operation. The internal volumes of the refrigerant extension pipes (the liquid refrigerant extension pipe 6 and the gas refrigerant extension pipe 7) calculated once in the initial learning are to be repeatedly used for subsequent refrigerant leakage detection. The initial learning will be described in detail later. As regards determination in step S5, if the initial learning has not yet been performed, the process proceeds to step S6. If the initial learning has been performed, the process proceeds to step S8.

In step S6, whether the current operation state meets an initial learning start requirement is determined. The initial learning start requirement is a requirement for determination as to whether the current operation state is under conditions where the total refrigerant amount can be accurately calculated. For example, the following requirement is set. Specifically, the refrigerant amount in the accumulator 24 is calculated on the basis of the density of saturated gas, assuming that the whole of the refrigerant in the accumulator 24 is gaseous. Accordingly, if an excess liquid refrigerant is accumulated in the accumulator 24, the amount of gas refrigerant will be calculated as the amount of refrigerant, though the liquid refrigerant is accumulated. Disadvantageously, the precise refrigerant amount cannot be calculated. Accordingly, a value calculated as the refrigerant amount in the accumulator 24 is smaller than the actual amount by the amount of excess liquid refrigerant. This inaccurate calculation affects the following steps, so that the standard refrigerant amount, $M_{rSTD}$, cannot be accurately calculated in step S35, which will be described later. The initial learning is therefore not performed under conditions that an excess liquid refrigerant is accumulated in the accumulator 24. In other words, a condition that the refrigerant is not accumulated in the accumulator 24 is designated as the initial learning start requirement.

Whether the refrigerant is accumulated in the accumulator 24 can be determined on the basis of determination based on the current operation data as to whether the degree of superheat SH of the refrigerant at the outlet of each of the indoor heat exchangers 42A and 42B (the degree of the superheat at the inlet of the compressor 21) is greater than or equal to 0. Specifically, if the degree of superheat SH is greater than or equal to 0, it is determined that the refrigerant is not accumulated in the accumulator 24. If the degree of superheat SH is less than 0, it is determined that the refrigerant is accumulated in the accumulator 24.

Whether the initial learning start requirement is met is determined in the above-described manner. If the operation state meets the requirement for initial learning, the process proceeds to initial learning processing (S7). If the operation state does not meet the requirement, the process returns to step S2 and the normal operation is continued. The initial learning will be described in detail later.

In step S8, the amount of refrigerant in each component of the refrigerant circuit 10 is calculated and the amounts are summed up to obtain the total refrigerant amount, $M_r$, charged in the refrigerating and air-conditioning apparatus 1. After acquisition of information items from the various sensors through the measurement section 3*a* in FIG. 2, the calculation section 3*b* calculates the total refrigerant amount $M_r$ using the measurement data and various data items (e.g., the internal volumes of the components, a volume ratio $\alpha$, the internal volume, $V_{PL}$, of the liquid refrigerant extension pipe 6, and the internal volume, $V_{PG}$, of the gas refrigerant extension pipe 6) stored in the storage section 3*c*. Note that the internal volume $V_{PL}$ of the liquid refrigerant extension pipe 6 and the internal volume $V_{PG}$ of the gas refrigerant extension pipe 7 have been calculated by initial learning and have been stored in the storage section 3*c*.

The amount of refrigerant is obtained by multiplication of a refrigerant density and an internal volume. Accordingly, a refrigerant amount $M_{r_otherP}$ in the parts other than the refrigerant extension pipes of the refrigerant circuit 10 can be obtained on the basis of the density of refrigerant passing through each part and the internal volume data stored in the storage section 3*c*. Furthermore, an extension-pipe refrigerant amount $M_P$ (the sum of the refrigerant amount in the liquid refrigerant extension pipe 6 and that in the gas refrigerant extension pipe 7) is calculated using the internal volume $V_{PL}$ of the liquid refrigerant extension pipe 6, the internal volume $V_{PG}$ of the gas refrigerant extension pipe 7, the density, $\rho_{PL}$, of refrigerant in the liquid refrigerant extension pipe 6, and the density, $\rho_{PG}$, of refrigerant in the gas refrigerant extension pipe 7 which have been obtained in the initial learning. A method of calculating the total refrigerant amount $M_r$ will be described in detail later.

(Step S9: Leakage Determination Based on Refrigerant Amount)

In step S9, the standard refrigerant amount (initial charge amount) $M_{rSTD}$ obtained in the initial learning, which will be described later, is compared to the total refrigerant amount $M_r$ calculated in step S8. If $M_{rSTD}=M_r$, it is determined that the refrigerant is not leaked. If $M_{rSTD}>M_r$, it is determined that the refrigerant is leaked. In the case where it is determined that the refrigerant is not leaked, a notification that the refrigerant amount is normal is provided in step S10. In the case where it is determined that the refrigerant is leaked, a notification that the refrigerant is leaked is provided in step S11. As regards notifications provided in steps S10 and S11, for example, the notification is displayed on the display section 3*f* and refrigerant leakage status data indicating a result of detection of whether the refrigerant is leaked is transmitted (provided) to the remote control center through the communication line or the like. In the case where the total refrigerant amount $M_r$ is not equal to the initial charge amount $M_{rSTD}$, it is determined that the refrigerant is leaked. In some cases, however, a value of the total refrigerant amount $M_r$ varies due to sensor error or the like upon calculation of the refrigerant amount. Accordingly, a threshold for determination as to whether the refrigerant is leaked may be determined in consideration of the above fact.

After providing the notification indicating a normal condition or abnormal condition, the control unit 3 proceeds to RETURN and repeats processing steps from step S1. Repeating processing steps of the above-described steps S1 to S11 performs refrigerant leakage detection during the normal operation at all times.

(Step S7: Initial Learning)

Figure 6:
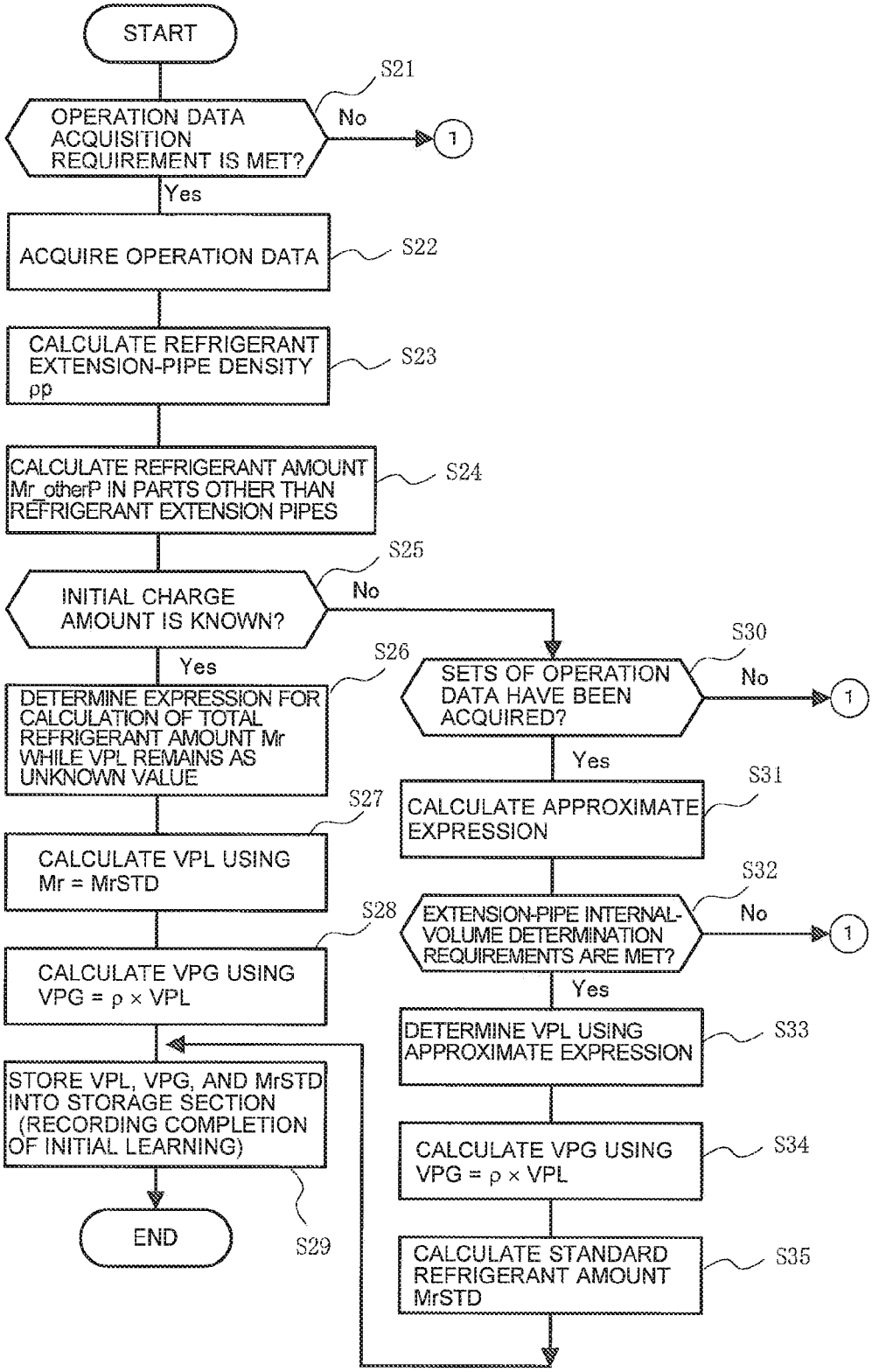
FIG. 6 is a flowchart of initial learning in the refrigerating and air-conditioning apparatus 1 according to Embodiment of the present invention.

FIG. 6 is a flowchart of the initial learning in the refrigerating and air-conditioning apparatus 1 according to Embodiment of the present invention. The initial learning will be described below with reference to FIG. 6. The initial learning includes two tasks, i.e., calculation of the internal volumes of the refrigerant extension pipes and calculation of the standard refrigerant amount$_D$. The standard refrigerant amount $M_{rSTD}$ is a reference amount used for refrigerant leakage detection, the reference amount serving as a reference to determine whether the refrigerant is leaked. Since the refrigerant tends to leak over time, it is necessary to calculate the standard refrigerant amount $M_{rSTD}$ as soon as possible after installation of the refrigerating and air-conditioning apparatus 1. In this case, it is assumed that the cooling operation is performed.

In step S21, whether the current operation state meets a previously set requirement for operation data acquisition is determined. If the current operation state does not meet the operation data acquisition requirement, the process returns to step S2 in FIG. 5 and the processing sequence of steps S2 to S7 is repeated until the operation state meets the operation data acquisition requirement. Embodiment is characterized in that the internal volumes of the refrigerant extension pipes (the liquid refrigerant extension pipe 6 and the gas refrigerant extension pipe 7) can be calculated on the basis of operation data acquired during normal operation without using a special operation mode. As regards the operation data used for calculation of the internal volumes of the refrigerant extension pipes, operation data obtained in an operation state that meets a predetermined operation data acquisition requirement is used. The operation data acquisition requirement in the case where the initial charge amount is known may be the same as the initial learning start requirement in step S21 or another requirement may be designated. In any case, an operation state where the refrigerant circuit operation is stable and the internal volumes of the refrigerant extension pipes can be accurately calculated is designated as an operation data acquisition requirement. Specifically, for example, the following requirements (A) to (C) are provided.

(A) Fluctuations of operation states of the components of the refrigerating and air-conditioning apparatus, for example, the operating frequency of the compressor, the opening degree of each expansion valve, and the rotation speed of the fan attached to each indoor heat exchanger lie within respective predetermined ranges. This means small fluctuations of each actuator.

(B) A value indicated by the discharge pressure sensor (high-pressure pressure sensor) 34*b* attached to the refrigerating and air-conditioning apparatus 1 is greater than or equal to a certain value and a value indicated by the suction pressure sensor (low-pressure pressure sensor) 34*a* is less than or equal to a certain value.

(C) The width of fluctuations of the difference between a refrigerant temperature (evaporating temperature) and an indoor temperature in each of the indoor heat exchangers 42A and 42B of the refrigerating and air-conditioning apparatus 1 is within a predetermined range and the width of fluctuations of the difference between a refrigerant temperature (condensing temperature) in the outdoor heat exchanger 23 and an outdoor temperature measured by the outdoor temperature sensor 33*c* is within a predetermined range.

In step S22, in the case where the current operation state meets the operation data acquisition requirement, operation data is automatically acquired at this time and held as initial learning operation data (S22).

In steps S23 and S24, an extension-pipe density $\rho_P$ and the refrigerant amount $M_{r_otherP}$ in the parts other than the refrigerant extension pipes are calculated using the operation data obtained during normal operation. The extension-pipe density $\rho_P$ and the refrigerant amount $M_{r_otherP}$ in the parts other than the refrigerant extension pipes are calculated on the basis of one set of operation data and calculations are stored in the storage section 3*c*. The extension-pipe density $\rho_P$ is a value calculated in consideration of both a density in the liquid side pipe and a density in the gas side pipe and is calculated by the following Expression (1).

$$\rho_P=\rho_{PL}+\alpha\rho_{PG} \tag{1}$$

Note that $\rho_{PL}$ denotes the mean density of refrigerant in the liquid refrigerant extension pipe (hereinafter, referred to as the "liquid-refrigerant extension-pipe density") [kg/m$^3$] and is derived from a condensing pressure (converted from the condensing temperature Tc obtained by the heat exchange temperature sensor 33*k*) and a temperature at the outlet of the subcooler 26 obtained by the liquid pipe temperature sensor 33*d*.

In addition, $\rho_{PG}$ denotes the mean density of refrigerant in the gas refrigerant extension pipe (hereinafter, referred to as the "gas-refrigerant extension-pipe density") [kg/m$^3$] and is derived from the refrigerant density on the suction side of the compressor 21 and a mean of the refrigerant densities at the outlets of the indoor heat exchangers 42A and 42B. The refrigerant density on the suction side of the compressor 21 is derived from the suction pressure Ps and the suction temperature Ts. The refrigerant density at the outlet of each of the indoor heat exchangers 42A and 42B is derived from an evaporating pressure Pe, serving as a value converted from the evaporating temperature Te, and a temperature at the outlet of the corresponding one of the indoor heat exchangers 42A and 42B.

Furthermore, $\alpha$ denotes the ratio of the volume of the liquid refrigerant extension pipe 6 to that of the gas refrigerant extension pipe 7 and is previously stored in the storage section 3*c* of the control unit 3.

The refrigerant amount $M_{r_otherP}$ in the parts other than the refrigerant extension pipes is the sum of a condenser refrigerant amount $M_{rc}$, an evaporator refrigerant amount $M_{re}$, an accumulator refrigerant amount $M_{rACC}$, and an oil-solved refrigerant amount $M_{rOIL}$. Methods of calculating these refrigerant amounts will be described later.

Subsequently, whether the amount of refrigerant initially charged in the refrigerating and air-conditioning apparatus 1 upon installation is known (has been input) is determined (S25). If the initial charge amount is known because, for example, a new refrigerating and air-conditioning apparatus 1 is installed or there is a record of the initial charge amount in the storage section 3*c*, the process proceeds to step S26. Whereas, if the initial charge amount is unknown because, for example, there is no record of the initial charge amount in the existing refrigerating and air-conditioning apparatus 1, the process proceeds to step S30.

Steps S26 to S29 describe a flow in the case where the initial charge amount is known.

(Known Initial Charge Amount)

Since the internal volume $V_{PL}$ of the liquid refrigerant extension pipe 6 is unknown, an expression for calculation of the total refrigerant amount $M_r$ is determined while the internal volume $V_{PL}$ remains as an unknown value. At this time, the internal volume $V_{PG}$ of the gas refrigerant extension pipe 7 is calculated using the liquid-refrigerant extension-pipe internal volume $V_{PL}$ by the following Expression (2).

$$V_{PG}=\alpha V_{PL} \tag{2}$$

In this case, the density of gas refrigerant in the gas refrigerant extension pipe 7 is low, one several tenths of the density of liquid refrigerant in the liquid refrigerant extension pipe 6. An effect of the internal volume $V_{PG}$ of the gas refrigerant extension pipe 7 on calculation of the total refrigerant amount $M_r$ is smaller than that of the internal volume $V_{PG}$ of the liquid refrigerant extension pipe 6 therefrom. Accordingly, the internal volume $V_{PG}$ of the gas refrigerant extension pipe 7 is simply calculated on the basis of the internal volume $V_{PL}$ of the liquid refrigerant extension pipe 6 using Expression (2) mentioned above in consideration of only the difference in diameter between the pipes without individual calculation of the internal volume $V_{PG}$ of the gas refrigerant extension pipe 7 and the internal volume $V_{PL}$ of the liquid refrigerant extension pipe 6. The volume ratio $\alpha$ is previously stored in the storage section 3*c* of the control unit 3.

In steps S26 and S27, as described above, the expression for calculation of the total refrigerant amount $M_r$ is determined using the initial learning operation data acquired in step S22 while the internal volume $V_{PL}$ of the liquid refrigerant extension pipe 6 remains as an unknown value. The internal volume $V_{PL}$ of the liquid refrigerant extension pipe 6 is then calculated on the basis of the fact that the total refrigerant amount $M_r$ given by this calculation expression is equal to the initial charge amount $M_{rSTD}$ which is known. The calculation of the total refrigerant amount $M_r$ is the same as the method of calculating the total refrigerant amount in the above-described step S8.

$$M_r=V_{PL}\times\rho_{PL}+(\alpha\times V_{PL})\times\rho_{PG}+M_{r_otherP}=M_{rSTD}$$

Accordingly, the internal volume $V_{PL}$ of the liquid refrigerant extension pipe 6 can be calculated as follows:

$$V_{PL}=(M_{rSTD}-M_{r_otherP})/(\rho_{PL}+\alpha\times\rho_{PG})$$

where $\rho_{PL}$: the refrigerant density in the liquid refrigerant extension pipe 6, $\alpha$: the ratio of the volume of the liquid refrigerant extension pipe 6 to that of the gas refrigerant extension pipe 7, $\rho_{PG}$: the refrigerant density of the gas refrigerant extension pipe 7, and $M_{r_otherP}$: the refrigerant amount in the parts other than the refrigerant extension pipes of the refrigerant circuit 10.

In the calculation expression of the total refrigerant amount $M_r$, the values other than the internal volume $V_{PL}$ and the volume ratio $\alpha$ are known values calculated on the basis of the operation data.

Subsequently, in step S28, the internal volume $V_{PL}$ of the liquid refrigerant extension pipe 6 obtained in step S26 is substituted into the above-described Expression (2) to calculate the internal volume $V_{PG}$ of the gas refrigerant extension pipe 7.

The liquid-refrigerant extension-pipe internal volume $V_{PL}$ and the gas-refrigerant extension-pipe internal volume $V_{PG}$, calculated in the above-described manner, and the standard refrigerant amount (initial charge amount in the case where the initial charge amount is known) $M_{rSTD}$ are stored into the storage section 3*c*, such as a memory. The initial learning in the case where the initial charge amount is known is completed (S29).

As described above, in the case where the initial charge amount is known, the internal volumes of the refrigerant extension pipes can be calculated in one operation.

(Unknown Initial Charge Amount)

In the case where the initial charge amount is known, the internal volumes of the refrigerant extension pipes can be calculated using one set of operation data. In the case where the initial charge amount is unknown, the internal volumes of the refrigerant extension pipes cannot be calculated if a plurality of (two or more) sets of operation data are not acquired. In step S30, therefore, whether a plurality of sets of operation data have been acquired is determined. If a plurality of sets of operation data have not yet been acquired, the process returns to step S2 in FIG. 5 and the normal operation is continued until the operation state meets the operation data acquisition requirement. Whereas, in the case where it is determined in step S30 that a plurality of sets of operation data have been acquired, the process proceeds to processing for approximate expression calculation. When the process proceeds to the processing for approximate expression calculation, therefore, a plurality of refrigerant extension-pipe densities $\rho_P$ and a plurality of refrigerant amounts $M_{r_otherP}$ in the parts other than the refrigerant extension pipes calculated on the basis of the plurality of sets of operation data have been stored in the storage section 3*c*. In the approximate expression calculation processing, an approximate expression indicating the relationship between the refrigerant extension-pipe density and the refrigerant amount in the parts other than the refrigerant extension pipes is formed using a group of calculation data items (the plurality of refrigerant extension-pipe densities $\rho_P$ and the plurality of refrigerant amounts $M_{r_other}$ in the parts other than the refrigerant extension pipes).

The approximate expression is needed for calculation of the internal volume of each refrigerant extension pipe. The principle of calculation of the refrigerant extension-pipe internal volume using the approximate expression will be described below.

Figure 7:
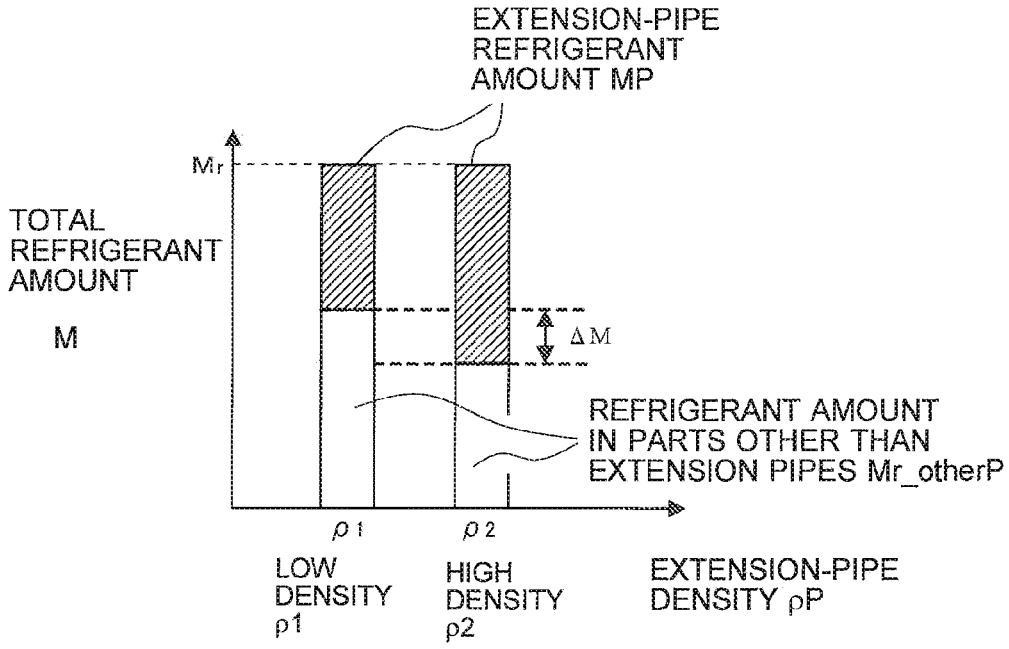
FIG. 7 is a diagram explaining that relative ratio of an extension-pipe refrigerant amount $M_P$ and a refrigerant amount $M_{r_otherP}$ in parts other than the extension pipe to a total refrigerant amount M changes with an extension-pipe density $\rho_P$.

FIG. 7 is a graph explaining that relative ratio of the extension-pipe refrigerant amount $M_P$ and the refrigerant amount $M_{r_otherP}$ in the parts other than the extension pipes to the total refrigerant amount M changes with the extension-pipe density $\rho_P$. In FIG. 7, each hatched portion indicates the extension-pipe refrigerant amount $M_P$ and each unhatched portion denotes the refrigerant amount $M_{r_otherP}$ in the parts other than the extension pipes. FIG. 7 demonstrates that when the total refrigerant amount M charged in the refrigerant circuit 10 is $M_r$, the ratio of the extension-pipe refrigerant amount $M_P$ to the refrigerant amount $M_{r_otherP}$ in the parts other than the extension pipes in the total refrigerant amount $M_r$ in the case where the extension-pipe density $\rho_P$ is low ($\rho$1) differs from that in the case where the extension-pipe density $\rho_P$ is high ($\rho$2).

Assuming that a refrigerant state in the refrigerant circuit 10 varies and the extension-pipe density $\rho_P$ changes from $\rho$1 to $\rho$2, the extension-pipe refrigerant amount $M_P$ is increased by $\Delta M$. In contrast, the refrigerant amount $M_{r_otherP}$ in the parts other than the extension pipes is reduced by $\Delta M$ which corresponds to an increase in the refrigerant amount $M_P$, namely, the same amount of change. Since the refrigerant amount $M_{r_otherP}$ in the parts other than the extension pipes and the extension-pipe density $\rho_P$ can be calculated on the basis of operation data in steps S23 and S24 as described above, the value $\Delta M$ can also be calculated. Considering the above fact that in the case where the extension-pipe density $\rho_P$ changes from a certain density $\rho$1 to $\rho$2, the extension-pipe refrigerant amount $M_P$ has the same change in refrigerant amount as that of the refrigerant amount $M_{r_otherP}$ in the parts other than the extension pipes, a procedure for calculating a refrigerant extension-pipe internal volume $V_P$ on the basis of the fact will be described below.

Figure 8:
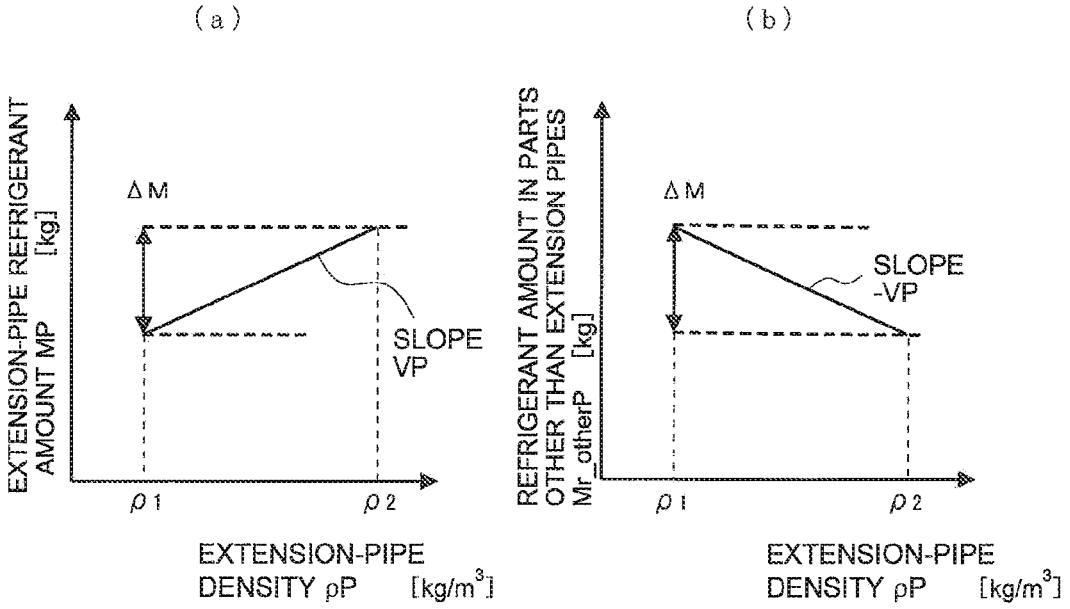
FIG. 8(*a*) is a graph related to the extension-pipe refrigerant amount $M_P$ in FIG. 7 and (*b*) is a graph related to the refrigerant amount $M_{r_otherP}$ in the parts other than the extension pipe in FIG. 7.

FIG. 8(*a*) is a graph related to the extension-pipe refrigerant amount $M_P$ in FIG. 7 and illustrates the relationship between the extension-pipe density $\rho_P$ and the extension-pipe refrigerant amount $M_P$. FIG. 8(*b*) is a graph related to the refrigerant amount $M_{r_otherP}$ in the parts other than the extension pipes in FIG. 7 and illustrates the relationship between the extension-pipe density $\rho_P$ and the refrigerant amount $M_{r_otherP}$ in the parts other than the extension pipes.

In this case, since the refrigerant amount can be calculated by multiplication of the internal volume and the density, the relation of $M_P=V_P\times\rho_P$ holds. Accordingly, a slope $V_P$ in FIG. 8(*a*) corresponds to the extension-pipe internal volume $V_P$ intended to be obtained. Since both $V_P$ and $M_P$ are unknown values, however, the slope $V_P$ cannot be derived from FIG. 8(*a*). Since the change in refrigerant amount in the case where the extension-pipe density $\rho_P$ changes from $\rho$1 to $\rho$2 is the same, $\Delta M$, in the parts other than the extension pipes, however, a slope in FIG. 8(*b*) is identical to the slope in FIG. 8(*a*). Since the refrigerant amount $M_{r_otherP}$ in the parts other than the extension pipes and the extension-pipe density $\rho_P$ can be calculated on the basis of operation data in steps S23 and S24 as described above, the slope $-V_P$ can also be calculated. The slope in FIG. 8(*b*) is therefore calculated and the absolute value thereof is obtained, so that the refrigerant extension-pipe internal volume $V_P$ can be obtained.

In this case, the extension-pipe refrigerant amount $M_P$ is the sum of the refrigerant amount in the liquid refrigerant extension pipe 6 and that in the gas refrigerant extension pipe 7 and is calculated by the following Expression (3).

$$M_P=(V_{PL}\times\rho_{PL})+(V_{PG}\times\rho_{PG}) \quad (3)$$

The internal volume $V_{PG}$ of the gas refrigerant extension pipe 7 is expressed using the liquid-refrigerant extension-pipe internal volume $V_{PL}$ in the above-described Expression (2). Accordingly, substitution of the above-described Expression (2) into Expression (3) yields the following Expression (4).

$$M_P=(V_{PL}\times\rho_{PL})+(\alpha V_{PL}\times\rho_{PG}) \quad (4)$$

Simplifying Expression (4) yields Expression (5).

$$M_P=(\rho_{PL}+\alpha\rho_{PG})\cdot V_{PL} \quad (5)$$

Since $\rho_{PL}+\alpha\rho_{PG}$ is equal to the extension-pipe density $\rho_P$, the absolute value of the slope in FIG. 8(*b*) corresponds to the liquid-refrigerant extension-pipe internal volume $V_{PL}$. Accordingly, the absolute value of the slope in FIG. 8(*b*) is obtained, so that the liquid-refrigerant extension-pipe internal volume $V_{PL}$ can be calculated. Furthermore, the gas-refrigerant extension-pipe internal volume $V_{PG}$ can also be calculated using Expression (2).

The above-described description shows the principle for calculating the extension-pipe internal volume. The procedure for calculation will be specifically described below.

Figure 9:
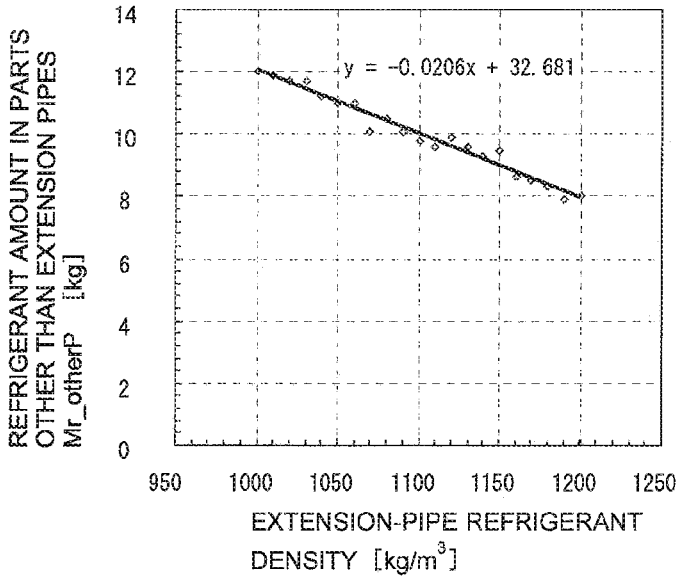
FIG. 9 is a graph illustrating an approximate line indicating the relationship between the refrigerant extension-pipe density $\rho_P$ and the refrigerant amount $M_{r_otherP}$ in the parts other than the extension pipe in the refrigerating and air-conditioning apparatus 1 according to Embodiment of the present invention.

As regards the group of calculation data items (the extension-pipe densities $\rho_P$ and the refrigerant amounts $M_{r_otherP}$ in the parts other than the extension pipes) calculated on the basis of the sets of operation data, points corresponding to the group of calculation data items are plotted onto an XY coordinate plane in which the axis of abscissas indicates the extension-pipe density $\rho_P$ and the axis of ordinates indicates the refrigerant amount $M_{r_otherP}$ in the parts other than the extension pipes, as illustrated in FIG. 9, which will be described below.

FIG. 9 illustrates a state in which a plurality of points are plotted on the XY coordinate plane in which the axis of abscissas indicates the extension-pipe density $\rho_P$ and the axis of ordinates indicates the refrigerant amount $M_{r_otherP}$ in the parts other than the extension pipes. The points plotted on the XY coordinate plane are points which are based on operation data obtained in a state where the operation data acquisition requirement is met and which indicate data obtained in a stable state of the refrigerant circuit 10.

A linear approximate expression is formed on the basis of the plotted points in FIG. 9 using a least squares approach. The absolute value of the slope of the linear approximate expression is the liquid-refrigerant extension-pipe internal volume $V_{PL}$, 0.0206 in the example of FIG. 9. A method of forming the linear approximate expression will be described later.

The above description shows the method for calculating the liquid-refrigerant extension-pipe internal volume $V_{PL}$ on the basis of a plurality of sets of operation data. Then, the flowchart of FIG. 6 will be described again.

In the case where it is determined in step S30 that a plurality of sets of operation data have been acquired, the group of calculation data items (the extension-pipe densities $\rho_P$ and the refrigerant amounts $M_{r_otherP}$ in the parts other than the extension pipes) calculated on the basis of the sets of operation data is read from the storage section 3*c*. The calculation section 3*b* calculates the approximate expression on the basis of the read group of calculation data items (S31). Whether requirements for determining the extension-pipe internal volume are met is determined (S32). If the extension-pipe internal-volume determination requirements are not met, the process returns to step S2 in FIG. 5. If the extension-pipe internal-volume determination requirements are met, the process proceeds to processing in step S33.

The extension-pipe internal-volume determination requirements are as follows.

First requirement: the difference between a maximum value and a minimum value of the refrigerant extension-pipe density $\rho_P$ is greater than or equal to a certain value in the group of calculation data items used for calculation of the approximate expression.

Second requirement: the calculated liquid-refrigerant extension-pipe internal volume $V_{PL}$ has an upper limit and a lower limit.

Third requirement: a predetermined range of data used is provided for the approximate expression formed on the basis of the data items which meet the first requirement. If data is outside the range, the data is eliminated and the approximate expression is again formed.

The liquid-refrigerant extension-pipe internal volume obtained when the above-described requirements are met is determined as a final calculation of the liquid-refrigerant extension-pipe internal volume $V_{PL}$.

The reason why the first requirement is set is that if the extension-pipe densities $\rho_P$ used for calculation of the approximate expression are close to each other, the slope of the approximate expression will significantly change due to a small error. A condition of setting the refrigerant extension-pipe densities $\rho_P$ used for calculation of the approximate expression to a wide range is added as described as the first requirement, so that the width of variation of the slope can be reduced. Advantageously, this makes measurement errors (a device error and an error caused by surrounding environments) of the sensors harder to affect. Accordingly, in the case where the group of calculation data items used for calculation of the approximate expression in step S31 does not meet the first requirement, the approximate expression is discarded and the liquid-refrigerant extension-pipe internal volume $V_{PL}$ is not determined. Furthermore, the first requirement may be used in step S30. If a group of calculation data items in which the difference between maximum and minimum values of the extension-pipe density $\rho_P$ is greater than or equal to the certain value is obtained, the process may proceed to processing for calculating the approximate expression.

Furthermore, the reason why the second requirement is set is that internal-volume upper and lower limits of the liquid-refrigerant extension-pipe internal volume $V_{PL}$ are predetermined depending on device and a calculated internal volume may be outside the limits. Since, however, the upper and lower limits of the calculated liquid-refrigerant extension-pipe internal volume $V_{PL}$ are set as described as the second requirement, incorrect calculation of the refrigerant amount can be prevented.

The reason why the third requirement is set is that if data including a large error is acquired, the slope becomes unstable due to an effect of the data. Since, however, data having a value significantly deviated from an approximate line formed on the basis of the data items meeting the first requirement is eliminated and the approximate line is again obtained as described as the third requirement, the effect of the error can be reduced and a highly accurate approximate expression can be obtained.

The liquid-refrigerant extension-pipe internal volume $V_{PL}$ is determined (S33) on the basis of the approximate expression only when the first to third requirements are met. Furthermore, it is preferable to meet all of the first to third requirements but such a condition is not limited to this case. Then, the internal volume $V_{PG}$ of the gas refrigerant extension pipe 7 is calculated using the above-described Expression (2) (S34). After that, the total refrigerant amount $M_r$ is calculated using the liquid-refrigerant extension-pipe internal volume $V_{PL}$ calculated in step S33 and the gas-refrigerant extension-pipe internal volume $V_{PG}$. A method of calculating the total refrigerant amount $M_r$ will be described later. Subsequently, the liquid-refrigerant extension-pipe internal volume $V_{PL}$ and the gas-refrigerant extension-pipe internal volume $V_{PG}$ calculated by the above-described process and the standard refrigerant amount (initial charge amount in the case where the initial charge amount is known) $M_{rSTD}$ are stored into the storage section 3*c*, such as a memory. The initial learning is completed.

(Method of Forming Linear Approximate Expression (Least Squares Approach))

The method of forming the linear approximate expression in step S31 in FIG. 6 will be described below.

[Math. 1]

$$f(X)=aX+b \tag{6}$$

When a measured point is X, the difference (Y−f(X)) between Y and a function value f(X) is calculated. If the square of the difference is small at each measured point, the values Y and f(X) are close to each other. The sum T of the squares of the differences is given by the following Expression (7).

[Math. 2]

$$T(\text{sum})=\Sigma(Y-f(X))^2 \tag{7}$$

Coefficients (a, b) of a function in which T (sum) in the following Expression (8) is the least is obtained. Substituting Expression (6) into Expression (7) yields the following Expression (8).

[Math. 3]

$$T=\Sigma(Y-aX-b)^2 \tag{8}$$

When an expression obtained by differentiating T in the above-described Expression (8) with respect to the coefficients (a, b) is 0, T in Expression (8) is the least.

In other words, the following Expressions (9) and (10) are given.

[Math. 4]

$$\delta T/\delta b=0 \tag{9}$$

[Math. 5]

$$\delta T/\delta a=0 \tag{10}$$

Solving and simplifying these expressions yields simultaneous equations with two unknowns as the following Expression (11).

[Math. 6]

$$\begin{bmatrix} \sum X^0 & \sum X^1 \\ \sum X^1 & \sum X^2 \end{bmatrix} \begin{bmatrix} b \\ a \end{bmatrix} = \begin{bmatrix} \sum X^0 Y \\ \sum X^1 Y \end{bmatrix} \tag{11}$$

The simultaneous equations with two unknowns can be expressed as the following matrices equation (determinants) (12).

[Math. 7]

$$A \times x = b \tag{12}$$

The determinants are solved as defined in Expression (13), the matrix X is calculated, and the coefficients a and b are calculated. This coefficient a denotes the liquid-refrigerant extension-pipe internal volume $V_{PL}$.

[Math. 8]

$$x=A^{(-1)}\times b \quad A^{(-1)} \text{ is the inverse matrix of } A \tag{13}$$

(Method of Calculating Total Refrigerant Amount $M_r$)

A method of calculating the refrigerant amount in Embodiment will be described with respect to the cooling operation as an example. Furthermore, the total refrigerant amount in the heating operation can be calculated using the same method.

A method of calculating the total refrigerant amount $M_r$ in the refrigerant circuit 10 by calculating the refrigerant amount in each component on the basis of the quantity of operation state of the component constituting the refrigerant circuit 10 will now be described.

The refrigerant amount in each component is obtained on the basis of the operation state of the component and the total refrigerant amount $M_r$ is obtained as the sum of the refrigerant amounts as illustrated in the following Expression (14):

[Math. 9]

$$M_r=M_{rc}+M_{re}+M_{rPL}+M_{rPG}+M_{rACC}+M_{rOIL} \tag{14}$$

Note that $M_{rc}$: the refrigerant amount in the condenser, $M_{re}$: the refrigerant amount in the evaporator, $M_{rPL}$: the refrigerant amount in the liquid refrigerant extension pipe, $M_{rPG}$: the refrigerant amount in the gas refrigerant extension pipe, $M_{rACC}$: the refrigerant amount in the accumulator, and $M_{rOIL}$: the oil-solved refrigerant amount.

Method of calculating the refrigerant amounts in the components will be sequentially described below.

(1) Calculation of Refrigerant Amount $M_{rc}$ in Outdoor Heat Exchanger 23 (Condenser)

Figure 10:
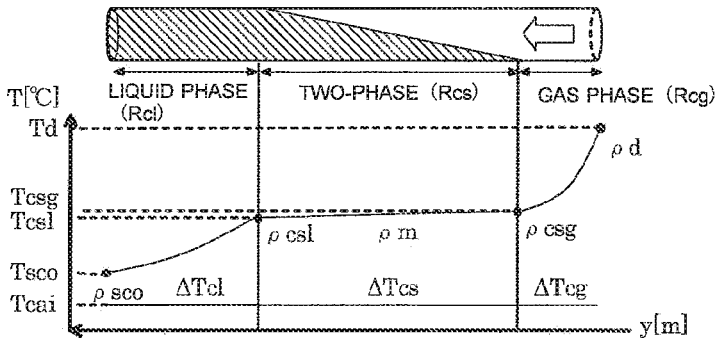
FIG. 10 is a schematic diagram illustrating a refrigerant state in a condenser 23 in the refrigerating and air-conditioning apparatus 1 according to Embodiment of the present invention.

The outdoor heat exchanger 23 functions as a condenser. FIG. 10 is a schematic diagram illustrating a refrigerant state in the condenser. At the inlet of the condenser, the refrigerant is gas-phase, since the degree of superheat on the discharge side of the compressor 21 is greater than 0 degrees C. At the outlet of the condenser, the refrigerant is liquid-phase, since the degree of subcooling is greater than 0 degrees C. In the condenser, the refrigerant in a gas-phase state at the temperature $T_d$ is cooled by the outdoor air at a temperature TA such that the refrigerant turns into saturated vapor at a temperature $T_{csg}$. The refrigerant in a two-phase state condenses by latent heat change so as to turn into saturated liquid at a temperature $T_{csl}$. The refrigerant is further cooled, so that it turns into liquid phase at a temperature $T_{sco}$.

The condenser refrigerant amount $M_{rc}$ [kg] is expressed by the following Expression (15).

[Math. 10]

$$M_{rc}=V_c\times\rho_c \tag{15}$$

A condenser internal volume $V_c$ [$m^3$] is known since it is an apparatus specification. A mean refrigerant density $\rho_c$ [kg/$m^3$] in the condenser is expressed by the following Expression (16).

[Math. 11]

$$\rho_c=R_{cg}\times\rho_{cg}+R_{cs}\times\rho_{cs}+R_{cl}\times\rho_{cl} \tag{16}$$

Note that $R_{cg}$, $R_{cs}$, and $R_{cl}$ [-] denote gas-phase, two-phase, and liquid-phase volumetric proportions, respectively, and $\rho_{cg}$, $\rho_{cs}$, $\rho_{cl}$ [kg/$m^3$] denote gas-phase, two-phase, and liquid-phase mean refrigerant densities, respectively. In order to calculate the mean refrigerant density in the condenser, the volumetric proportion and the mean refrigerant density in each phase have to be calculated.

(1.1) Calculation of Gas-Phase, Two-Phase, Liquid-Phase Mean Refrigerant Densities in Condenser (a) Calculation of Gas-Phase Mean Refrigerant Density $\rho_{cg}$ The gas-phase mean refrigerant density $\rho_{cg}$ is a mean value of, for example, a condenser inlet density $\rho_d$ and a saturated vapor density $\rho_{csg}$ in the condenser, and is given by the following Expression (17).

[Math. 12]

$$\rho_{cg}=\frac{\rho_d+\rho_{csg}}{2} \tag{17}$$

In this case, the condenser inlet density $\rho_d$ can be calculated on the basis of a condenser inlet temperature (corresponding to the discharge temperature $T_d$) and a pressure (corresponding to the discharge pressure $P_d$). In addition, the saturated vapor density $\rho_{csg}$ in the condenser can be calculated on the basis of the condensing pressure (discharge pressure $P_d$).

(b) Calculation of Two-Phase Mean Refrigerant Density $\rho_{cs}$

The two-phase mean refrigerant density $\rho_{cs}$ is expressed by the following Expression (18).

[Math. 13]

$$\rho_{cs}=\int_0^1[f_{cg}\times\rho_{csg}+(1-f_{cg})\times\rho_{csl}]dx \tag{18}$$

Note that x denotes the degree of dryness [-] and $f_{cg}$ denotes the void fraction [-] in the condenser. $f_{cg}$ is expressed by the following Expression (19).

[Math. 14]

$$f_{cg}=\frac{1}{1+\left(\frac{1}{x}-1\right)\frac{\rho_{csg}}{\rho_{csl}}s}) \tag{19}$$

Note that s denotes the slip ratio [-]. Many experimental formulae have been proposed as arithmetic expressions for the slip ratio s. The slip ratio is expressed as a function of a mass flux $Gm_r$ [kg/($m^2$s)], the discharge pressure $P_d$, and the degree of dryness x by the following Expression (20).

[Math. 15]

$$s=f(G_{mr},P_d,x) \tag{20}$$

(c) Calculation of Liquid-Phase Mean Refrigerant Density $\rho_{cl}$

The liquid-phase mean refrigerant density $\rho_{cl}$ is a mean value of, for example, a condenser outlet density $\rho_{sco}$ and a saturated liquid density $\rho_{csl}$ in the condenser, and is given by the following Expression (21).

[Math. 16]

$$\rho_{cl}=\frac{\rho_{sco}+\rho_{csl}}{2} \tag{21}$$

In this case, the condenser outlet density $\rho_{sco}$ can be calculated on the basis of a condenser outlet temperature $T_{sco}$ obtained by the liquid side temperature sensor 203 and a pressure (corresponding to the discharge pressure $P_d$). Furthermore, the saturated liquid density $\rho_{csl}$ in the condenser can be derived by saturation conversion of a compressor outlet pressure.

The mass flux $Gm_r$ changes depending on the operating frequency of the compressor. Accordingly, the slip ratio s is calculated using this method, so that a change in calculated refrigerant amount $M_r$ relative to the operating frequency of the compressor can be detected.

The gas-phase, two-phase, and liquid-phase mean refrigerant densities $\rho_{cg}$, $\rho_{cs}$, and $\rho_{cl}$ [kg/$m^3$] necessary for calculation of the condenser mean refrigerant density are calculated in the above-described manner.

(1.2) Calculation of Gas-Phase, Two-Phase, and Liquid-Phase Volumetric Proportions in Condenser A method of calculating the ratio between the gas-phase, two-phase, and liquid-phase volumetric proportions ($R_{cg}$:$R_{cs}$:$R_{cl}$) [-] in the condenser will now be described. Since the volumetric proportion is expressed by the ratio between heat transfer areas, the following Expression (22) holds.

[Math. 17]

$$R_{cg}:R_{cs}:R_{cl}=\frac{A_{cg}}{A_c}:\frac{A_{cs}}{A_c}:\frac{A_{cl}}{A_c} \tag{22}$$

Note that $A_{cg}$, $A_{cs}$, and $A_{cl}$ denote gas-phase, two-phase, and liquid-phase heat transfer areas [$m^2$] in the condenser, respectively, and $A_c$ denotes the heat transfer area [$m^2$] of the condenser. Furthermore, let ΔH [kJ/kg] denote the specific enthalpy difference in each of a gas-phase region, a two-phase region, and a liquid-phase region and let ΔTm [° C.] denote the mean temperature difference between the refrigerant and a medium that changes heat with the refrigerant. The following Expression (23) holds for each phase by heat balance.

[Math. 18]

$$G_r \times \Delta H = AK\Delta T_m \tag{23}$$

Note that $G_r$ denotes the mass flow rate [kg/h] of the refrigerant, A denotes the heat transfer area [$m^2$], and K denotes the overall heat transfer coefficient [kW/($m^2$·° C.)]. Assuming that the flux of heat in each phase is constant, the overall heat transfer coefficient K is constant and the volumetric proportion is proportional to a value obtained by division of the specific enthalpy difference ΔH [kJ/kg] by the difference ΔT [° C.] between the temperature of the refrigerant and that of the outdoor air.

In each path, however, wind speed distribution allows a place that is kept out of wind to have less liquid phase and allows a place that tends to be exposed to wind to have more liquid phase, because heat transfer is facilitated. The refrigerant may be unevenly distributed. Furthermore, since the temperature difference between the refrigerant and the outdoor air is small in the liquid phase, the heat flux in the liquid phase may be lower than those in the gas phase and the two-phase. To calculate the volumetric proportion of each phase, therefore, the above-described phenomenon is corrected by multiplication of the liquid-phase term by a condenser liquid-phase proportion correction coefficient β[-]. Accordingly, the following Expression (24) is derived.

[Math. 19]

$$R_{cg}:R_{cs}:R_{cl} = \frac{\Delta H_{cg}}{\Delta T_{cg}}:\frac{\Delta H_{cs}}{\Delta T_{cs}}:\beta\frac{\Delta H_{cl}}{\Delta T_{cl}} \tag{24}$$

Note that $\Delta H_{cg}$, $\Delta H_{cs}$, and $\Delta H_{cl}$ denote gas-phase, two-phase, and liquid-phase refrigerant specific enthalpy differences [kJ/kg] and $\Delta T_{cg}$, $\Delta T_{cs}$, and $\Delta T_{cl}$ denote the temperature differences [° C.] between the phases and the outdoor air.

In this case, the condenser liquid-phase proportion correction coefficient β is a value derived from measurement data and varies depending on device specifications, particularly, a condenser specification.

$\Delta H_{cg}$ is obtained by subtraction of the specific enthalpy of saturated vapor from the specific enthalpy at the inlet of the condenser (corresponding to the discharge specific enthalpy of the compressor 21). The discharge specific enthalpy is obtained by calculation of the discharge pressure $P_d$ and the discharge temperature $T_d$ and the specific enthalpy of saturated vapor in the condenser can be calculated on the basis of the condensing pressure (corresponding to the discharge pressure $P_d$).

$\Delta H_{cs}$ is obtained by subtraction of the specific enthalpy of saturated liquid in the condenser from the specific enthalpy of saturated vapor in the condenser. The saturated liquid specific enthalpy in the condenser can be calculated on the basis of the condensing pressure (corresponding to the discharge pressure $P_d$).

$\Delta H_{cl}$ is obtained by subtraction of the specific enthalpy at the outlet of the condenser from the saturated liquid specific enthalpy in the condenser. The condenser outlet specific enthalpy can be obtained by calculation of the condensing pressure (corresponding to the discharge pressure $P_d$) and the condenser outlet temperature $T_{sco}$.

For example, assuming that the temperature of the outdoor air hardly changes, the temperature difference $\Delta T_{cg}$ [° C.] between the gas phase and the outdoor air is expressed as a logarithmic mean temperature difference using the condenser inlet temperature (corresponding to the discharge temperature $T_d$), the saturated vapor temperature $T_{csg}$ [° C.] in the condenser, and an outdoor-air inlet temperature $T_{ca}$ [° C.] by the following Expression (25).

[Math. 20]

$$\Delta T_{cg} = \frac{(T_d - T_{ca}) - (T_{csg} - T_{ca})}{\ln\frac{(T_d - T_{ca})}{(T_{csg} - T_{ca})}} \tag{25}$$

Note that the saturated vapor temperature $T_{csg}$ in the condenser can be calculated on the basis of the condensing pressure (corresponding to the discharge pressure $P_d$).

The mean temperature difference $\Delta T_{cs}$ between the two-phase and the outdoor air is expressed using the saturated vapor temperature $T_{csg}$ and the saturated liquid temperature $T_{csl}$ in the condenser by the following Expression (26).

[Math. 21]

$$\Delta T_{cs} = \frac{T_{csg} + T_{csl}}{2} - T_{ca} \tag{26}$$

The saturated liquid temperature $T_{csl}$ in the condenser can be calculated on the basis of the condensing pressure (corresponding to the discharge pressure $P_d$).

A mean temperature difference $\Delta T_{cl}$ between the liquid phase and the outdoor air is expressed as a logarithmic mean temperature difference using the condenser outlet temperature $T_{sco}$, the saturated liquid temperature $T_{csl}$ in the condenser, and the suction temperature of the outdoor air by the following Expression (27).

[Math. 22]

$$\Delta T_{cl} = \frac{(T_{csl} - T_{ca}) - (T_{sco} - T_{ca})}{\ln\frac{(T_{csl} - T_{ca})}{(T_{sco} - T_{ca})}} \tag{27}$$

The ratio ($R_{cg}$:$R_{cs}$:$R_{cl}$) between the volumetric proportions of the respective phases can be calculated in the above-described manner.

The mean refrigerant density and the volumetric proportion in each phase can be calculated in the above-described manner, so that the mean refrigerant density $\rho_c$ in the condenser can be calculated.

(2) Calculation of Refrigerant Amounts $M_{rPL}$ and $M_{rPG}$ in Extension Pipes The liquid-refrigerant extension-pipe refrigerant amount $M_{rPL}$ [kg] and the gas-refrigerant extension-pipe refrigerant amount $M_{rPG}$ [kg] are expressed by the following Expressions (28) and (29).

[Math. 23]

$$M_{rPL} = V_{PL} \times \rho_{PL} \tag{28}$$

[Math. 24]

$$M_{rPG} = V_{PG} \times \rho_{PG} \tag{29}$$

In this case, $\rho_{PL}$ is obtained by calculation of, for example, a liquid-refrigerant extension-pipe inlet temperature (corresponding to the condenser outlet temperature $T_{sco}$) and a liquid-refrigerant extension-pipe inlet pressure (corresponding to the discharge pressure $P_d$).

In addition, $\rho_{PG}$ is obtained by calculation of, for example, a gas-refrigerant extension-pipe outlet temperature (corresponding to the suction temperature Ts) and a liquid-refrigerant extension-pipe outlet pressure (corresponding to the suction pressure Ps). $V_{PL}$ denotes the liquid-refrigerant extension-pipe internal volume [$m^3$] and $V_{PG}$ denotes the gas-refrigerant extension-pipe internal volume [$m^3$] and values obtained by initial learning are used.

(3) Calculation of Refrigerant Amounts $M_{re}$ in Indoor Heat Exchangers 42A and 42B (Evaporators)

Figure 11:
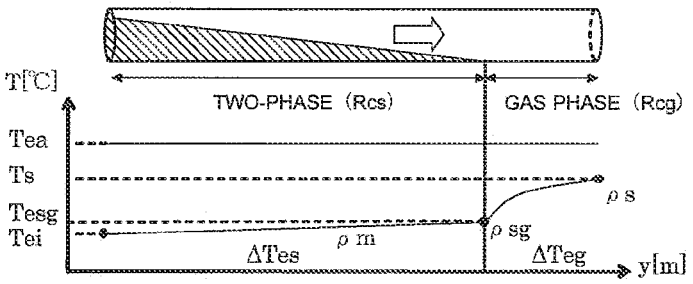
FIG. 11 is a schematic diagram of a refrigerant state in each of evaporators 42A and 42B in the refrigerating and air-conditioning apparatus 1 according to Embodiment of the present invention.

The indoor heat exchangers 42A and 42B each function as an evaporator. FIG. 11 is a schematic diagram illustrating a refrigerant state in the evaporator. At the inlet of the evaporator, the refrigerant is two-phase. At the outlet of the evaporator, the refrigerant is gas-phase, since the degree of superheat on the suction side of the compressor 21 is greater than 0 degrees C. At the inlet of the evaporator, the refrigerant in a two-phase state at a temperature $T_{ei}$ [° C.] is heated by sucked indoor air at the temperature TA [° C.] such that it turns into saturated vapor at a temperature $T_{esg}$ [° C.], and is then further heated such that it is gas-phase at the temperature Ts [° C.]. The evaporator refrigerant amount $M_{re}$ [kg] is expressed by the following Expression (30).

[Math. 25]

$$M_{re}=V_e\times\rho_e \tag{30}$$

Note that $V_e$ denotes the internal volume [$m^3$] of the evaporator and is known because it is a device specification. $\rho_e$ denotes the mean refrigerant density [kg/$m^3$] in the evaporator and is expressed by the following Expression (31).

[Math. 26]

$$\rho_e=R_{es}\times\rho_{es}+R_{eg}\times\rho_{eg} \tag{31}$$

Note that $R_{eg}$ and $R_{es}$ denote the gas-phase and two-phase volumetric proportions [-], respectively, and $\rho_{es}$ and $\rho_{eg}$ denote the two-phase and gas-phase mean refrigerant densities [kg/$m^3$], respectively. In order to calculate the mean refrigerant density in the evaporator, the volumetric proportion and the mean refrigerant density in each phase have to be calculated.

(3.1) Calculation of Gas-Phase and Two-Phase Mean Refrigerant Densities in Evaporator (a) Calculation of Two-Phase Mean Refrigerant Density $\rho_{es}$ [kg/$m^3$] in Evaporator The two-phase mean refrigerant density $\rho_{es}$ is expressed by the following Expression (32).

[Math. 27]

$$\rho_{es}=\int_{xei}^{1}[f_{eg}\times\rho_{esg}+(1-f_{eg})\times\rho_{esl}]dx \tag{32}$$

Note that x denotes the degree of dryness [-] of the refrigerant and $f_{eg}$ denotes the void fraction [-] in the evaporator. $f_{eg}$ is expressed by the following Expression (33).

[Math. 28]

$$f_{eg}=\frac{1}{1+\left(\frac{1}{x}-1\right)\frac{\rho_{esg}}{\rho_{esl}}s} \tag{33}$$

Note that s denotes the slip ratio [-]. Many experimental formulae have been proposed as arithmetic expressions for the slip ratio s. The slip ratio is expressed as a function of the mass flux $GM_r$[kg/($m^2$s)], the suction pressure $P_s$, and the degree of dryness x by the following Expression (34).

[Math. 29]

$$s=f(G_m,P_s,x) \tag{34}$$

The mass flux $Gm_r$ changes depending on the operating frequency of the compressor. Accordingly, the slip ratio s is calculated using this method, so that a change in calculated refrigerant amount $M_r$ relative to the operating frequency of the compressor can be detected.

(b) Calculation of Gas-Phase Mean Refrigerant Density $\rho_{eg}$ [kg/$m^3$] in Evaporator The gas-phase mean refrigerant density $\rho_{eg}$ in the evaporator is a mean of, for example, a saturated vapor density $\rho_{es}$g in the evaporator and an evaporator outlet density, and is given by the following Expression (35).

[Math. 30]

$$\rho_{eg}=\frac{\rho_{esg}+\rho_s}{2} \tag{35}$$

In this case, the saturated vapor density $\rho_{esg}$ in the evaporator can be calculated on the basis of the evaporating pressure (corresponding to the suction pressure $P_s$). The evaporator outlet density (corresponding to a suction density $\rho_s$) can be calculated on the basis of an evaporator outlet temperature (corresponding to the suction temperature Ts) and a pressure (corresponding to the suction pressure Ps).

The two-phase and gas-phase mean refrigerant densities $\rho_{es}$ and $\rho_{eg}$ [kg/$m^3$] necessary for calculation of the mean refrigerant density in the evaporator are calculated in the above-described manner.

(3.2) Calculation of Two-Phase and Gas-Phase Volumetric Proportions in Evaporator A method of calculating the volumetric proportions of the respective phases will now be described. Since each volumetric proportion is expressed by the ratio between heat transfer areas, the following Expression (36) holds.

[Math. 31]

$$R_{es}:R_{eg}=\frac{A_{es}}{A_e}:\frac{A_{eg}}{A_e} \tag{36}$$

Note that $A_{es}$ and $A_{eg}$ denote two-phase and gas-phase heat transfer areas in the evaporator, respectively, and $A_e$ denotes the heat transfer area of the evaporator. Furthermore, ΔH denotes the specific enthalpy difference in each of a two-phase region and a gas-phase region and ΔTm denotes the mean temperature difference between the refrigerant and a medium that changes heat with the refrigerant. The following Expression (37) holds for each phase by heat balance.

[Math. 32]

$$G_r\times\alpha H=AK\Delta T_m \tag{37}$$

Note that $G_r$ denotes the mass flow rate [kg/h] of the refrigerant, A denotes the heat transfer area [$m^2$], and K denotes the overall heat transfer coefficient [kW/($m^2$·° C.)]. Assuming that the flux of heat in each phase is constant, the overall heat transfer coefficient K is constant and the volumetric proportion is proportional to a value obtained by division of the specific enthalpy difference ΔH [kJ/kg] by the difference ΔT [° C.] between the temperature of the refrigerant and that of the outdoor air. The following proportional Expression (38) holds.

[Math. 33]

$$R_{es}:R_{eg} = \frac{\Delta H_{es}}{\Delta T_{es}}:\frac{\Delta H_{eg}}{\Delta T_{eg}} \tag{38}$$

$\Delta H_{es}$ is obtained by subtraction of a specific enthalpy at the inlet of the evaporator from the specific enthalpy of saturated vapor in the evaporator. The saturated vapor specific enthalpy in the evaporator is obtained by calculation of the evaporating pressure (corresponding to the suction pressure) and the evaporator inlet specific enthalpy can be calculated on the basis of the condenser outlet temperature $T_{sco}$.

$\Delta H_{eg}$ is obtained by subtraction of the saturated vapor specific enthalpy in the evaporator from a specific enthalpy (corresponding to a suction specific enthalpy) at the outlet of the evaporator. The evaporator outlet specific enthalpy can be obtained by calculation of an outlet temperature (corresponding to the suction temperature Ts) and a pressure (corresponding to the suction pressure Ps).

For example, assuming that the temperature of the indoor air hardly changes, the mean temperature difference $\Delta T_{es}$ between the two-phase in the evaporator and the indoor air is expressed by the following Expression (39).

[Math. 34]

$$\Delta T_{es} = T_{ea} - \frac{T_{esg} + T_{ei}}{2} \tag{39}$$

In this case, the saturated vapor temperature $T_{esg}$ in the evaporator is calculated on the basis of the evaporating pressure (corresponding to the suction pressure Ps). The evaporator inlet temperature $T_{ei}$ can be calculated on the basis of the evaporating pressure (corresponding to the suction pressure Ps). $T_{ea}$ denotes the indoor air temperature.

A mean temperature difference $\Delta T_{eg}$ between the gas phase and the indoor air is expressed as a logarithmic mean temperature difference by the following Expression (40).

[Math. 35]

$$\Delta T_{eg} = \frac{(T_{ea} - T_{esg}) - (T_{ea} - T_{eg})}{\ln\frac{(T_{ea} - T_{esg})}{(T_{ea} - T_{eg})}} \tag{40}$$

In this case, an evaporator outlet temperature $T_{eg}$ is obtained as the suction temperature Ts.

The ratio between the two-phase and gas-phase volumetric proportions ($R_{es}:R_{eg}$) can be calculated in the above-described manner.

The mean refrigerant density and the volumetric proportion in each phase can be calculated in the above-described manner, so that the mean refrigerant density $\rho_e$ in the evaporator can be calculated.

(4) Calculation of Accumulator Refrigerant Amount $M_{rACC}$

At the inlet and the outlet of the accumulator, the degree of superheat on the suction side of the compressor 21 is greater than 0 degrees C. Accordingly, the refrigerant is gas-phase. The accumulator refrigerant amount $M_{rACC}$ [kg] is expressed by the following Expression (41).

[Math. 36]

$$M_{rACC}=V_{ACC}\times\rho_{ACC} \tag{41}$$

Note that $V_{ACC}$ denotes the internal volume [$m^3$] of the accumulator and is a known value because it is determined by device specifications. $\rho_{ACC}$ denotes the mean refrigerant density [$kg/m^3$] in the accumulator and is obtained by calculation of an accumulator inlet temperature (corresponding to the suction temperature Ts) and an inlet pressure (corresponding to the suction pressure Ps).

(5) Calculation of Amount $M_{rOIL}$ of Refrigerant Solved in Refrigeration Oil

The amount $M_{rOIL}$ [kg] of refrigerant solved in refrigeration oil is expressed by the following Expression (42).

[Math. 37]

$$M_{rOIL}=V_{OIL}\times\rho_{OIL}\times\phi_{OIL} \tag{42}$$

Note that $V_{OIL}$ denotes the volume [$m^3$] of the refrigeration oil existing in the refrigerant circuit and is known because it is a device specification. $\rho_{OIL}$ denotes the density [$kg/m^3$] of the refrigeration oil and $\phi_{OIL}$ denotes the solubility [-] of the refrigerant in the oil. Assuming that most of the refrigeration oil exists in the compressor and the accumulator, the refrigeration oil density $\rho_{OIL}$ can be regarded as a constant value. Furthermore, the solubility $\phi$ [-] of the refrigerant in the oil is calculated on the basis of the suction temperature Ts and the suction pressure Ps as expressed by the following Expression (43).

[Math. 38]

$$\phi_{OIL}=f(T_s,P_s) \tag{43}$$

As described above, (1) the condenser refrigerant amount $M_{rc}$, (2) the extension-pipe refrigerant amount $M_P$ (the sum of the liquid-refrigerant extension-pipe refrigerant amount $M_{rPL}$ and the gas-refrigerant extension-pipe refrigerant amount $M_{rPG}$), (3) the evaporator refrigerant amount $M_{re}$, (4) the accumulator refrigerant amount $M_{rACC}$, and (5) the oil-solved refrigerant amount $M_{rOIL}$ can be calculated. All of these refrigerant amounts are summed up, so that the total refrigerant amount $M_r$ can be obtained.

The correction method is not limited to the above-described method so long as correction related to a liquid-phase term is performed. As the number of corrected points is larger, the refrigerant amount can be calculated with higher accuracy.

As described above, according to Embodiment, when the apparatus enters an operation state, which meets an operation data acquisition requirement, during normal operation, operation data obtained at this time is automatically sequentially acquired as initial learning operation data. The refrigerant amounts in the parts other than the extension pipes and the extension-pipe densities are calculated on the basis of a plurality of sets of operation data and the internal volume of each extension pipe is then calculated on the basis of a group of data items indicating the calculations. Accordingly, the internal volume of each refrigerant extension pipe can be calculated using operation data acquired during normal operation without a specific operation for calculating the refrigerant extension-pipe internal volume. Furthermore, simply starting a normal operation permits calculation of the refrigerant extension-pipe internal volume and detection of refrigerant leakage to be automatically performed. Advantageously, time and effort to perform a special operation, which has been performed, can be eliminated.

Furthermore, even if the refrigerating and air-conditioning apparatus 1 is an existing apparatus and the internal volume of each refrigerant extension pipe is unknown, performing the initial learning enables the internal volume of each refrigerant extension pipe and the refrigerant amount in the refrigerant extension pipes to be easily calculated on the basis of operation data acquired during normal operation. In calculation of the internal volume of each refrigerant extension pipe and determination as to whether the refrigerant is leaked, therefore, time and effort to input information regarding the refrigerant extension pipes can be reduced as much as possible.

Furthermore, before initial learning, whether the initial learning start requirement is met is determined. Specifically, the internal volume of each refrigerant extension pipe is finally calculated on the basis of operation data acquired in an operation state in which an excess liquid refrigerant is not accumulated in the accumulator 24. Accordingly, the refrigerant extension-pipe internal volume and the standard refrigerant amount can be accurately calculated. The refrigerant amount in the refrigerant extension pipes can therefore be calculated with high accuracy, so that calculation of the total amount of refrigerant in the refrigerating and air-conditioning apparatus and detection of refrigerant leakage can be accurately performed. Consequently, refrigerant leakage can immediately be detected. The refrigerating and air-conditioning apparatus as well as natural environment can be prevented from being damaged.

Furthermore, if the number of calculation data items is small, various errors may affect a calculation of each extension-pipe internal volume. In the above description, however, the extension-pipe internal volume is calculated on the basis of a group of calculation data items. Advantageously, this makes the errors harder to affect.

Furthermore, to calculate the extension-pipe internal volume on the basis of a group of calculation data items, an approximate expression indicating the relationship between the refrigerant extension-pipe density and the refrigerant amount in the parts other than the refrigerant extension pipes is formed on the basis of the group of calculation data items, and the slope of the approximate expression is calculated as the refrigerant extension-pipe internal volume. Consequently, the refrigerant extension-pipe internal volume can easily be calculated.

The refrigerant extension pipes include the liquid refrigerant extension pipe 6 and the gas refrigerant extension pipe 7. The densities in both the pipes fluctuate in a normal operation. It is therefore necessary to calculate the extension-pipe density $\rho_P$ in consideration of the fluctuations of the densities in the two pipes. To calculate the extension-pipe density $\rho_P$, the relational expression (the above-described Expression (2)) indicating that the internal volume of the gas refrigerant extension pipe 7 is equal to a value of the product of the internal volume of the liquid refrigerant extension pipe 6 and the volume ratio $\alpha$ is used. Thus, the extension-pipe density $\rho_P$ can be calculated by the above-described Expression (1).

The refrigerant extension-pipe internal volume obtained when the extension-pipe internal-volume determination requirements are met is determined as a final calculation of the refrigerant extension-pipe internal volume. Accordingly, if operation data including various errors obtained during normal operation is used, the effect of errors is less, so that the refrigerant extension-pipe internal volume can be calculated with high accuracy. Thus, the reliability of the result of calculation can be increased.

In addition, the above-described requirements (A) to (C) are designated as the operation data acquisition requirements to designate an operation state in which a refrigerant cycle operation is stable. Accordingly, the refrigerant extension-pipe internal volume can be accurately calculated.

In the above-described Embodiment, whether the refrigerant is leaked is determined by comparison between the standard refrigerant amount (initial charge amount) $M_{rSTD}$ and the total refrigerant amount $M_r$ in step S9. The following method may be used. The determination is made using a rate of refrigerant leakage (the ratio of the total calculated refrigerant amount to a proper refrigerant amount) r [%]. The refrigerant leakage rate r is calculated on the basis of the initial charge amount $M_{rSTD}$ obtained by initial learning and the total refrigerant amount $M_r$ calculated in step S8 by the following Expression (44).

[Math. 39]

$$r = \frac{M_{rSTD} - M_r}{M_{rSTD}} \times 100 \tag{44}$$

The determination section 3*d* compares the calculated refrigerant leakage rate r with a threshold value x[%] previously stored in the storage section 3*c* to determine no leakage of refrigerant when r<X and determine the leakage of refrigerant when X<r. In this method, since a value indicating the refrigerant amount may vary due to a sensor error or the like upon calculation, the threshold value is determined in consideration of such a case. In the case where the refrigerant is not leaked, notification indicating that the refrigerant amount is normal is provided in step S10. In the case where the refrigerant is leaked, notification indicating the refrigerant leakage is provided in step S11.

Upon providing the notification indicating the refrigerant leakage, the refrigerant leakage rate r is output to display means, such as a display, thus enabling an operator to easily check the status of the refrigerant amount in the refrigerant circuit.

Moreover, displaying the refrigerant leakage rate r enables the operator to grasp more details of the state of the apparatus. Thus, ease of maintenance can be increased.

Furthermore, the refrigerating and air-conditioning apparatus may be connected to a network to constitute a refrigerant amount determination system. Specifically, a local controller, serving as a control device, is connected which controls the components of the refrigerating and air-conditioning apparatus and communicates with an external device through telephone lines, LAN lines, or radio waves to acquire operation data. The local controller is connected through a network to a remote server of an information management center which receives the operation data related to the refrigerating and air-conditioning apparatus. In addition, the remote server is connected to a storage device, such as a disk drive, for storing operation state quantities. Thus, the refrigerant amount determination system can be achieved. For example, the local controller may function as a measurement unit configured to acquire operation state quantities of the refrigerating and air-conditioning apparatus and also function as a calculation unit configured to calculate operation state quantities, the storage device may function as a storage unit, and the remote server may function as a comparison unit and a determination unit. In this case, the refrigerating and air-conditioning apparatus does not have to have functions for calculation and comparison of the calculated refrigerant amount and the refrigerant leakage rate based on the current operation state quantities. Furthermore, constructing such a system capable of remote monitoring allows an operator upon periodic maintenance to eliminate the necessity to go to a site and perform an operation of determining whether the refrigerant is leaked. Thus, the reliability of the apparatus and ease of operation thereof are increased.

While Embodiment of the present invention has been described with reference to the drawings, a specific configuration is not limited to those in Embodiment. Changes and modifications may be made without departing from the spirit and scope of the invention. For example, in the above-described Embodiment, the case where the present invention is applied to the refrigerating and air-conditioning apparatus capable of switching between cooling and heating operations has been described as an example. The present invention is not limited to the case. The present invention may be applied to a refrigerating and air-conditioning apparatus only for cooling or heating. Furthermore, in the above-described Embodiment, the refrigerating and air-conditioning apparatus including the single heat source unit and the use units has been described as an example. The present invention is not limited to this case. The present invention may be applied to a refrigerating and air-conditioning apparatus including a plurality of heat source units and a plurality of use units.

Furthermore, in Embodiment, the degree of superheat on the suction side of the compressor 21 is set to be greater than 0 degrees C., such that the accumulator 24 is charged with the gas refrigerant. For example, a sensor for detecting a liquid level in the accumulator 24 may be provided. If the liquid refrigerant is present in the accumulator 24, the sensor can detect the liquid level, so that the ratio of the volume of the liquid refrigerant to that of the gas refrigerant is known. Thus, the amount of refrigerant that is present in the accumulator 24 can be calculated.

Furthermore, the above-described initial learning permits the time and effort to input information, such as the lengths of the refrigerant extension pipes, to be reduced as much as possible and enables the internal volumes of the refrigerant extension pipes to be calculated on the basis of normal operation data. The output section 3*h* transmits refrigerant leakage status data to, for example, the control center through a communication line, thus achieving continuous remote monitoring. Unexpected leakage of refrigerant can therefore be immediately dealt with before occurrence of an abnormal condition, such as damage on a device or a reduction in capacity. Thus, the progression of refrigerant leakage can be suppressed as much as possible. Advantageously, the reliability of the refrigerating and air-conditioning apparatus 1 is increased, and environmental conditions can be prevented from deteriorating due to the leaked refrigerant. In addition, such an undesirable condition that an operation is forced to be continued with a small amount of refrigerant reduced by the refrigerant leakage can be prevented. Thus, the life of the refrigerating and air-conditioning apparatus 1 can be increased.

While the above description relates to the case where whether the refrigerant is leaked is determined, the present invention can be applied to determination upon, for example, charging the refrigerant as to whether the amount of refrigerant is excessive.

REFERENCE SIGNS LIST

1, refrigerating and air-conditioning apparatus; 2, outdoor unit; 3, control unit; 3*a*, measurement section; 3*b*, calculation section; 3*c*, storage section; 3*d*, determination section; 3*e*, drive section, 3*f*, display section; 3*g*, input section; 3*h*, output section; 4A, 4B, indoor unit (use unit); 6, liquid refrigerant extension pipe; 6A, liquid main pipe; 6*a*, liquid branch pipe; 7, gas refrigerant extension pipe; 7A, gas main pipe; 7*a*, gas branch pipe; 10, refrigerant circuit; 10*a*, indoor side refrigerant circuit; 10*b*, indoor side refrigerant circuit; 10*c*, outdoor side refrigerant circuit; 10*z*, main refrigerant circuit; 21, compressor; 22, four-way valve; 23, outdoor heat exchanger; 24, accumulator; 26, subcooler; 27, outdoor fan; 28, liquid side closing valve; 29, gas side closing valve; 31, outdoor side control unit; 32*a*, indoor side control unit; 33*a*, suction temperature sensor; 33*b*, discharge temperature sensor; 33*c*, outdoor temperature sensor; 33*d*, liquid pipe temperature sensor; 33*e*, liquid side temperature sensor; 33*f*, gas side temperature sensor; 33*g*, indoor temperature sensor; 33*h*, liquid side temperature sensor; 33*i*, gas side temperature sensor; 33*j*, indoor temperature sensor; 33*k*, heat exchange temperature sensor; 33*l*, liquid side temperature sensor; 33*z*, bypass temperature sensor; 34*a*, suction pressure sensor; 34*b*, discharge pressure sensor; 41A, 41B, expansion valve; 42A, 42B, indoor heat exchanger; 43A, 43B, indoor fan; 51*a*, branch unit; 52*a*, branch unit; 71, bypass; and 72, bypass flow control valve.

The invention claimed is:

1. A refrigerating and air-conditioning apparatus comprising:

a refrigerant circuit including an outdoor unit, serving as a heat source unit, and an indoor unit, serving as a use side unit, connected by a refrigerant extension pipe;

a plurality of temperature sensors and a plurality of pressure sensors;

a control unit having a memory configured to store data, the control unit configured to:

measure, as operation data, a temperature and a pressure of a refrigerant in a plurality of locations of the refrigerant circuit excluding the refrigerant extension pipe;

determine if, an operation state indicated by operation data measured by the control unit during normal operation meets an operation data acquisition requirement;

acquire the operation data as initial learning operation data if the control unit determines the operation state meets the operation data acquisition requirement;

perform a process of calculating calculation data items including an amount of refrigerant in parts other than the refrigerant extension pipe and a density of refrigerant in the refrigerant extension pipe on the basis of the initial learning operation data;

calculate the internal volume of the extension pipe on the basis of a group of the calculation data items acquired by the process of calculating;

calculate a standard refrigerant amount, serving as a criterion for determining whether the refrigerant is leaked from the refrigerant circuit, on the basis of the calculated refrigerant extension pipe internal volume and the initial learning operation data;

store the refrigerant extension pipe internal volume and the standard refrigerant amount in the memory; and calculate a total amount of refrigerant in the refrigerant circuit on the basis of the refrigerant extension pipe internal volume stored in the memory and operation data measured by the control unit during normal operation, and compare the calculated total refrigerant amount with the standard refrigerant amount stored in the memory to determine whether the refrigerant is leaked.

2. The refrigerating and air-conditioning apparatus of claim 1, wherein the control unit forms, on the basis of the group of calculation data items, an approximate expression indicating the relationship between the extension-pipe refrigerant density and the refrigerant amount in the parts other than the extension pipe, and obtains the absolute value of the slope of the approximate expression as the refrigerant extension pipe internal volume.

3. The refrigerating and air-conditioning apparatus of claim 1, wherein the refrigerant extension pipe includes a liquid refrigerant extension pipe and a gas refrigerant extension pipe, and wherein the control unit multiplies a gas-refrigerant extension pipe refrigerant density, calculated on the basis of operation data, by a predetermined coefficient of a relational expression indicating that the internal volume of the gas refrigerant extension pipe is equal to the product of the internal volume of the liquid refrigerant extension pipe and the predetermined coefficient, and adds a liquid-refrigerant extension pipe refrigerant density, calculated on the basis of operation data, to the product of the gas-refrigerant extension pipe refrigerant density and the predetermined coefficient to obtain the refrigerant extension pipe refrigerant density.

4. The refrigerating and air-conditioning apparatus of claim 1, wherein the control unit determines, as a final calculation of the refrigerant extension pipe internal volume, the refrigerant extension pipe internal volume calculated using a group of calculation data items in which the difference between maximum and minimum values of the refrigerant extension pipe refrigerant density is greater than or equal to a certain value.

5. The refrigerating and air-conditioning apparatus of claim 1, wherein when the calculated refrigerant extension pipe internal volume lies within a range of predetermined upper and lower limits, the control unit determines this refrigerant extension pipe internal volume as a final calculation of the refrigerant extension pipe internal volume.

6. The refrigerating and air-conditioning apparatus of claim 1, wherein the control unit is further configured to have a remote monitoring function for transmitting data indicating the presence or absence of refrigerant leakage to a control center through a communication line.

7. The refrigerating and air-conditioning apparatus of claim 1, wherein the operation data acquisition requirement includes a requirement in which fluctuations of each operation state are within a predetermined range, the operation states indicating the operating frequency of a compressor, the opening degree of an expansion valve, and the rotation speed of a fan attached to each of an indoor heat exchanger and an outdoor heat exchanger, the compressor, the expansion valve, and the indoor and outdoor heat exchangers serving as components of the refrigerating and air-conditioning apparatus.

8. The refrigerating and air-conditioning apparatus of claim 1, comprising a high-pressure sensor, wherein the operation data acquisition requirement includes a requirement in which a value indicated by the high-pressure pressure sensor that detects the pressure of a high-pressure refrigerant in the refrigerant circuit is greater than or equal to a certain value, and a value indicated by a low-pressure pressure sensor that detects the pressure of a low-pressure refrigerant in the refrigerant circuit is less than or equal to a certain value.

9. The refrigerating and air-conditioning apparatus of claim 1, wherein the operation data acquisition requirement includes a requirement in which the width of fluctuations of the difference between a refrigerant temperature in an indoor heat exchanger in the indoor unit and an indoor temperature is within a predetermined range, and the width of fluctuations of the difference between a refrigerant temperature in an outdoor heat exchanger in the outdoor unit and an outdoor temperature is within a predetermined range.

10. The refrigerating and air-conditioning apparatus of claim 1, further comprising:

wherein the control is configured to transmit data indicating a result of determination by the determination section to an external device.

11. The refrigerating and air-conditioning apparatus of claim 2, wherein the control unit provides a predetermined range of data used for the formed approximate line, the range lying between upper and lower limits of the refrigerant amount in the parts other than the refrigerant extension pipe, eliminates data outside the range to recalculate the approximate line, and determines, as a final calculation of the refrigerant extension pipe internal volume, the absolute value of the slope of the recalculated approximate expression.

* * * * *